US005562584A

United States Patent [19]

Romanauskas

[11] Patent Number: 5,562,584

[45] Date of Patent: Oct. 8, 1996

[54] TENSION BAND CENTRIFUGE ROTOR

[75] Inventor: William A. Romanauskas, Southbury, Conn.

[73] Assignee: E. I. Du Pont de Nemours and Company, Wilmington, Del.

[21] Appl. No.: 468,906

[22] Filed: Jun. 6, 1995

Related U.S. Application Data

[63] Continuation-in-part of Ser. No. 324,854, Oct. 18, 1994, abandoned, which is a continuation of Ser. No. 79,225, Jun. 18, 1993, abandoned, which is a continuation of Ser. No. 664,174, Mar. 1, 1991, abandoned, which is a continuation-in-part of Ser. No. 389,085, Aug. 2, 1989, abandoned.

[51] Int. Cl.[6] ..... B04B 5/02

[52] U.S. Cl. ..... 494/20; 494/16; 494/81; 74/572

[58] Field of Search ..... 494/16–21, 37, 494/43, 81, 85; 366/342, 343; 74/572, 573 R, 573 F, 574; 210/145, 360.1, 380.1, 380.3, 781; 422/72, 99

[56] References Cited

U.S. PATENT DOCUMENTS

| | | | |
|---|---|---|---|
| 618,196 | 1/1899 | Ashworth et al. . | |
| 3,028,075 | 4/1962 | Blum | 494/20 |
| 3,602,066 | 8/1971 | Wetherbee et al. | 74/572 |
| 3,602,067 | 8/1971 | Wetherbee et al. | 74/572 |
| 3,797,737 | 5/1974 | Kadotani et al. . | |
| 3,913,828 | 10/1975 | Roy . | |
| 3,964,341 | 6/1976 | Rabenhorst | 74/572 |
| 3,982,447 | 9/1976 | Rabenhorst | 74/572 |
| 3,993,243 | 11/1976 | Dietzel et al. . | |
| 3,997,106 | 12/1976 | Baram . | |
| 4,020,714 | 5/1977 | Rabenhorst | 74/572 |
| 4,023,437 | 5/1977 | Rabenhorst | 74/572 |
| 4,036,080 | 7/1977 | Friedericy et al. | 74/572 |
| 4,039,006 | 8/1977 | Inoue et al. | 138/129 |
| 4,093,118 | 6/1978 | Sinn et al. . | |
| 4,120,450 | 10/1978 | Whitehead . | |
| 4,123,949 | 11/1978 | Knight, Jr. et al. | 74/572 |
| 4,160,521 | 7/1979 | Lindgren . | |
| 4,176,563 | 12/1979 | Younger | 74/572 |
| 4,198,878 | 4/1980 | Lewis et al. | 74/572 |
| 4,207,778 | 6/1980 | Hatch | 74/572 |
| 4,244,240 | 1/1981 | Rabenhorst | 74/572 |
| 4,266,442 | 5/1981 | Zorzi | 74/572 |
| 4,285,251 | 8/1981 | Swartout | 74/572 |
| 4,341,001 | 7/1982 | Swartout | 29/159 |
| 4,359,912 | 11/1982 | Small | 74/572 |
| 4,370,899 | 1/1983 | Swartout | 74/572 |
| 4,408,500 | 10/1983 | Kulkarni et al. | 74/572 |

(List continued on next page.)

FOREIGN PATENT DOCUMENTS

| | | | |
|---|---|---|---|
| 473870 | 1/1948 | Canada . | |
| 0081968 | 12/1982 | European Pat. Off. . | |
| 290687 | 11/1988 | European Pat. Off. | 494/38 |
| 2082274 | 11/1971 | France . | |
| 2538719 | 10/1975 | France . | |
| 1782602 | 3/1972 | Germany | 494/20 |
| 3346289 | 7/1984 | Germany . | |
| 58-30548 | 2/1983 | Japan . | |
| 62-39292 | 8/1987 | Japan . | |
| 63-29139 | 6/1988 | Japan . | |
| 63-319073 | 12/1988 | Japan . | |
| 296421 | 4/1954 | Switzerland | 494/20 |
| 492308 | 11/1975 | U.S.S.R. | 494/20 |
| 794277 | 2/1979 | U.S.S.R. . | |
| 1174615 | 11/1983 | U.S.S.R. . | |
| 505446 | 5/1939 | United Kingdom | 494/20 |
| 1353390 | 8/1971 | United Kingdom . | |
| 1605218 | 9/1977 | United Kingdom . | |
| 2097297 | 4/1982 | United Kingdom . | |
| 2107615 | 5/1983 | United Kingdom | 494/85 |
| WO91/02302 | 2/1991 | WIPO . | |
| WO92/15930 | 9/1992 | WIPO . | |

*Primary Examiner*—Charles E. Cooley

[57] ABSTRACT

The present invention relates to an applied load accepting band for a centrifuge rotor that is configured such that, while rotating, the applied loads on the band are balanced by the tension in the band, so that during rotation the band is subjected only to a tensile force.

24 Claims, 16 Drawing Sheets

U.S. PATENT DOCUMENTS

| | | | |
|---|---|---|---|
| 4,443,727 | 4/1984 | Annen et al. | 320/261 |
| 4,468,269 | 8/1984 | Carey | 156/175 |
| 4,481,840 | 11/1984 | Friedericy et al. | 74/572 |
| 4,502,349 | 3/1985 | Abiven et al. | 74/572 |
| 4,548,596 | 10/1985 | Sutton III et al. | 494/20 |
| 4,585,433 | 4/1986 | Cole | 494/20 |
| 4,585,434 | 4/1986 | Cole | 494/20 |
| 4,586,918 | 5/1986 | Cole | 494/20 |
| 4,589,864 | 5/1986 | Cole | 494/20 |
| 4,624,655 | 11/1986 | Cole | 494/20 |
| 4,659,325 | 4/1987 | Cole et al. | 494/20 |
| 4,670,004 | 6/1987 | Sharples et al. | 494/16 X |
| 4,675,001 | 6/1987 | Johanson | 494/85 |
| 4,701,157 | 10/1987 | Potter | 494/16 |
| 4,817,453 | 4/1989 | Breslich, Jr. et al. | 74/572 |
| 4,860,610 | 8/1989 | Popper et al. | 74/572 |
| 4,886,486 | 12/1989 | Grimm et al. | 494/20 |
| 4,991,462 | 2/1991 | Breslich, Jr. et al. | 74/573 R |
| 5,057,071 | 10/1991 | Piramoon | 494/81 X |

mass = dm
density = y
22
$d_s$
A
H
t/12T
$d\theta$
$R_{AVG}$ $F_x$
$F_y$
F
12
22
22L-2
22C
t/12T
$T_o$
$R_o$
x
y
$R_{IN}$
$R_{OUT}$
R
$R_{AVG}$
$R_{ACTUAL}$
$R_L$
$\theta$
$T_x$
$d_x$
T
$d_s$
$T_y$
$d_y$
dR
$T_R$
$T_\theta$
$Rd\theta$
(Radius adjacent end point of portion of band)

TENSION BAND CENTRIFUGE ROTOR

BACKGROUND OF THE INVENTION

CROSS REFERENCE TO RELATED APPLICATIONS

This application is a continuation-in-part of application Ser. No. 08/324,854, filed Oct. 18, 1994 (IP-535-C), now abandoned, which is itself a continuation of application Ser. No. 08/079,225, filed Jun. 18, 1993 (IP-535-B), now abandoned, which is itself a continuation of application Ser. No. 07/664,174, filed Mar. 1, 1991 (IP-535-A), now abandoned, which is itself a continuation-in-part of application Ser. No. 07/389,085, filed Aug. 2, 1989, now abandoned.

FIELD OF THE INVENTION

The present invention relates to a band for a centrifuge rotor, and in particular, to a band configured such that, in operation, it is subjected only to tensile forces.

DESCRIPTION OF THE PRIOR ART

The manufacture of rotating structures, such as centrifuge rotors and energy storage flywheels, has evolved frown the use of homogeneous materials, such as aluminum and titanium, toward the use of composite materials. The use of such materials is believed advantageous because it permits the attainment of increased centrifugal load carrying capability. The increased load carrying capability is achieved because the lighter weight of the composite rotor permits it to spin faster for a given motive input, thus resulting in a greater relative centrifugal force.

The rotating structures of the prior art believed relevant to the present invention each have some form of band that, while at rest, exhibits a predetermined arbitrary shape. However, such a band is subjected during operation to a load due to the tendency of the band to change from the arbitrary rest shape to some equilibrium rotating shape. This phenomenon may be understood from the following simplified example.

Consider an applied load accepting band for a centrifuge rotor that in the rest (i.e., non-spinning) condition is circular in shape. Assume that this band accepts three applied loads corresponding to three equiangularly spaced sample carriers. When such a rotor is spun the effects of centrifugal force on the sample carriers apply loads that act radially outward, tending to pull the band to form "corners". The perimeter of the band generally intermediate the applied loads will thus deflect radially inwardly from their original circular shape. Since the band has some predetermined stiffness associated with it, the deflection of the band from its rest shape to its equilibrium shape while rotating imposes a bending stress on the band. This bending stress in the band does not contribute to its load carrying capability, and in fact, is deleterious to the band since it results in reduced rotor life.

In view of the foregoing it is believed advantageous to provide a centrifuge rotor which is not exposed to the stresses associated with the change in shape as the band is spun, thus avoiding the deleterious effects attendant therewith

SUMMARY OF THE INVENTION

In general, the present invention relates to an applied load accepting band for a centrifuge rotor that is configured such that, while rotating, the applied loads on the band are balanced by the tension in the band, so that during rotation the band is subjected only to a tensile force.

In a first aspect, if (1) the region on the band at which an applied load is considered to act is small with respect to the distance on the band between applied loads (i.e. the load is considered to act at a point), and (2) if the thickness of the band is neglected, the band while at rest (and unmounted) or while mounted to the struts of a rotor and at operating speed has a shape between the applied load accepting regions of the band that is defined by or approximates the shape determined by the following paired set of equations:

$$d(R/R_0)/d\Theta=(R/R_0)^2 RAD\ (1-\{K/2[(R/R_0)^2-1]\})^2-(R/R_0)^2 \quad (1)$$

$$K=[(\gamma\omega^2 R_0^2)\ (1/g)\ (1/\sigma_0)] \quad (2)$$

Such a band will be subjected to only tensile force.

In a more detailed aspect, the effects of a Compensating Moment to compensate for bending stresses introduced into the band as a result of the band's thickness of the band are taken into account. The band in accordance with this aspect of the invention while at rest (and unmounted) or while mounted to the struts of a rotor and at operating speed has a shape between the applied load accepting regions of the band that is defined by or approximates the shape determined by the following paired set of equations:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

where $$K=[(\gamma\omega^2 R_0^2)\ (1/g)\ (1/\sigma_0)],\ 0<K<1 \quad (2)$$

Equation (1A) defines the equilibrium curve of the band between the load regions modified to accommodate the thickness of the band taking into account the Compensating Moment. It should be noted that as the thickness (t) approaches zero, the compensating moment will also approach zero, and Equation (1A) then reverts to the form of Equation (1) (in which the thickness t is neglected).

In an even more derailed aspect the present invention relates to a load accepting band wherein the load accepting region has a finite circumferential length and wherein the Compensating Moment that compensates for bending stresses introduced into the band due to its thickness is accommodated both in the region of the band between the load accepting regions and also within the load accepting region. In such an instance the band in the load accepting region is defined by or approximates the shape determined by the following paired set of equations:

$$\frac{d\left(\frac{R}{R_L}\right)}{d\theta} = \left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=\{ZR_L+[t^2/((6(2R_L-t))]\}/\{R_L+[t^2/((6(2R_L-t))]\}$$

$$K_1=[(\gamma\omega^2R_L^2)\ (1/g)\ (1/\sigma_0)]$$

$$K_2=[(R_2\sigma_cH)/T_0] \quad (2B)$$

where $Z=R_0/R_L$

Equation (1B) and the set of equations indicated by the character (2B) represent the optimized equilibrium equation for the band in the load accepting regions The region of the band spanning the load accepting regions is defined by or approximates the shape determined by the following paired set of equations:

$$\frac{d\left(\frac{R}{R_0}\right)}{d\theta} = \left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1} \quad (1BB)$$

where $$LR=Load\ Ratio=\{ZR_L+[t^2/((6(2R_L-t))]\}/\{R_L+[t^2/((6(2R_L-t))]\}$$

$$K_1=[(\gamma\omega^2R_L^2)\ (1/g)\ (1/\sigma_0)]$$

$$K_2=[(R_2\sigma_cH)/T_0] \quad (2B)$$

where $Z=R_0/R_L$

BRIEF DESCRIPTION OF THE DRAWINGS

The invention will be more fully understood from the following detailed description thereof, taken in connection with the accompanying drawings, which form a part of this application, and in which:

FIG. 1 is a plan view of a generalized centrifuge rotor (with the sample carriers omitted for clarity) having an applied load accepting band in accordance with the present invention, while

FIG. 3A is a free body diagram of a portion of a band for a centrifuge rotor in accordance with the present invention in which the applied load accepting band is realized using a wound band formed of a composite material that has a constant thickness dimension from which the equation describing the shape of such a band may be derived, while FIGS. 3B through 3D illustrate the mathematical relationships used in the derivation of the Appendix, and in which

Figure 1:
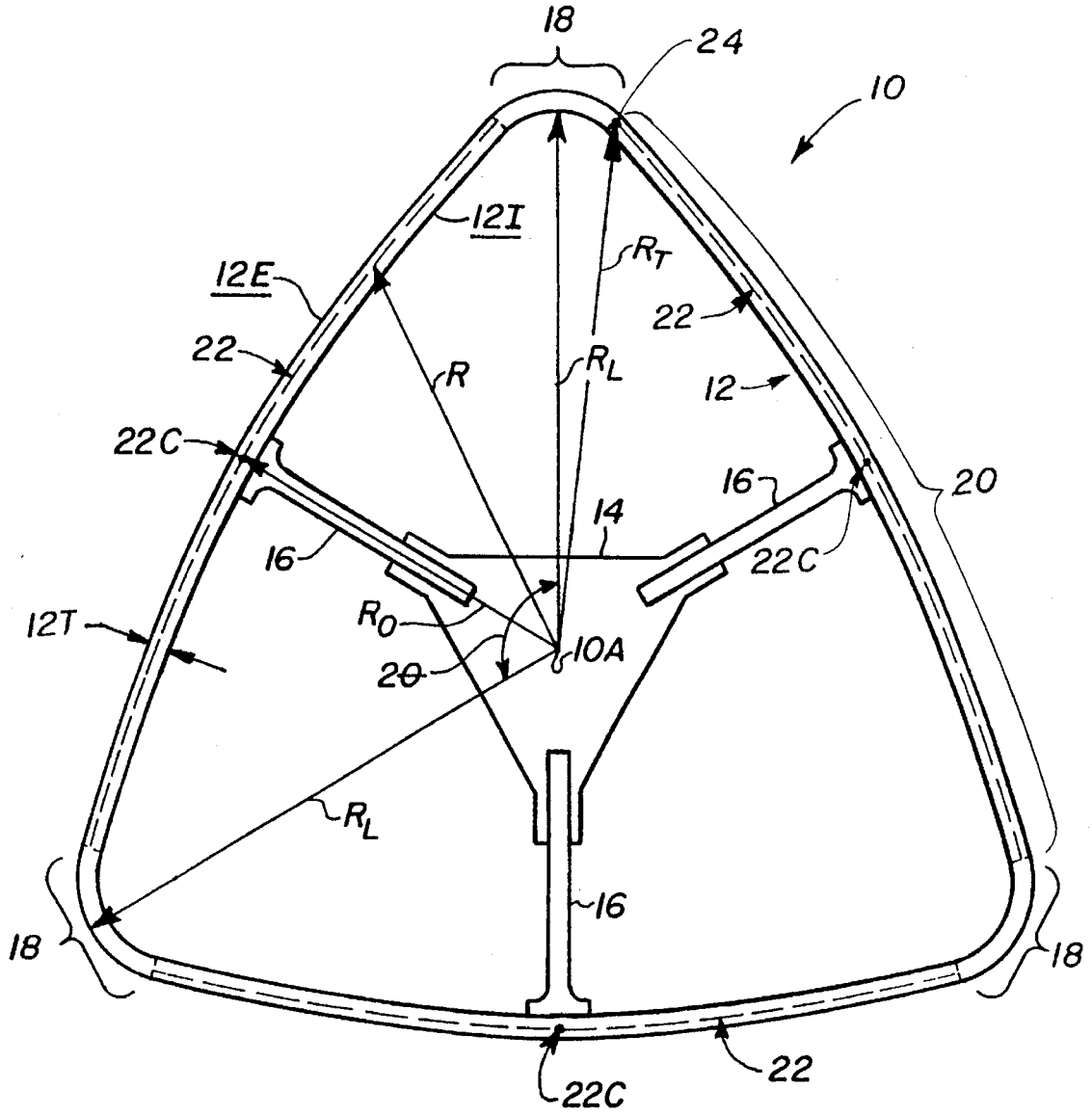

An Appendix setting forth the derivation of the equations discussed herein is included in this specification in a location following the description and preceding the claims, the Appendix forming part of this application.

DETAILED DESCRIPTION OF THE INVENTION

Throughout the following detailed description similar reference numerals refer to similar elements in all figures of the drawings.

Figure 2:
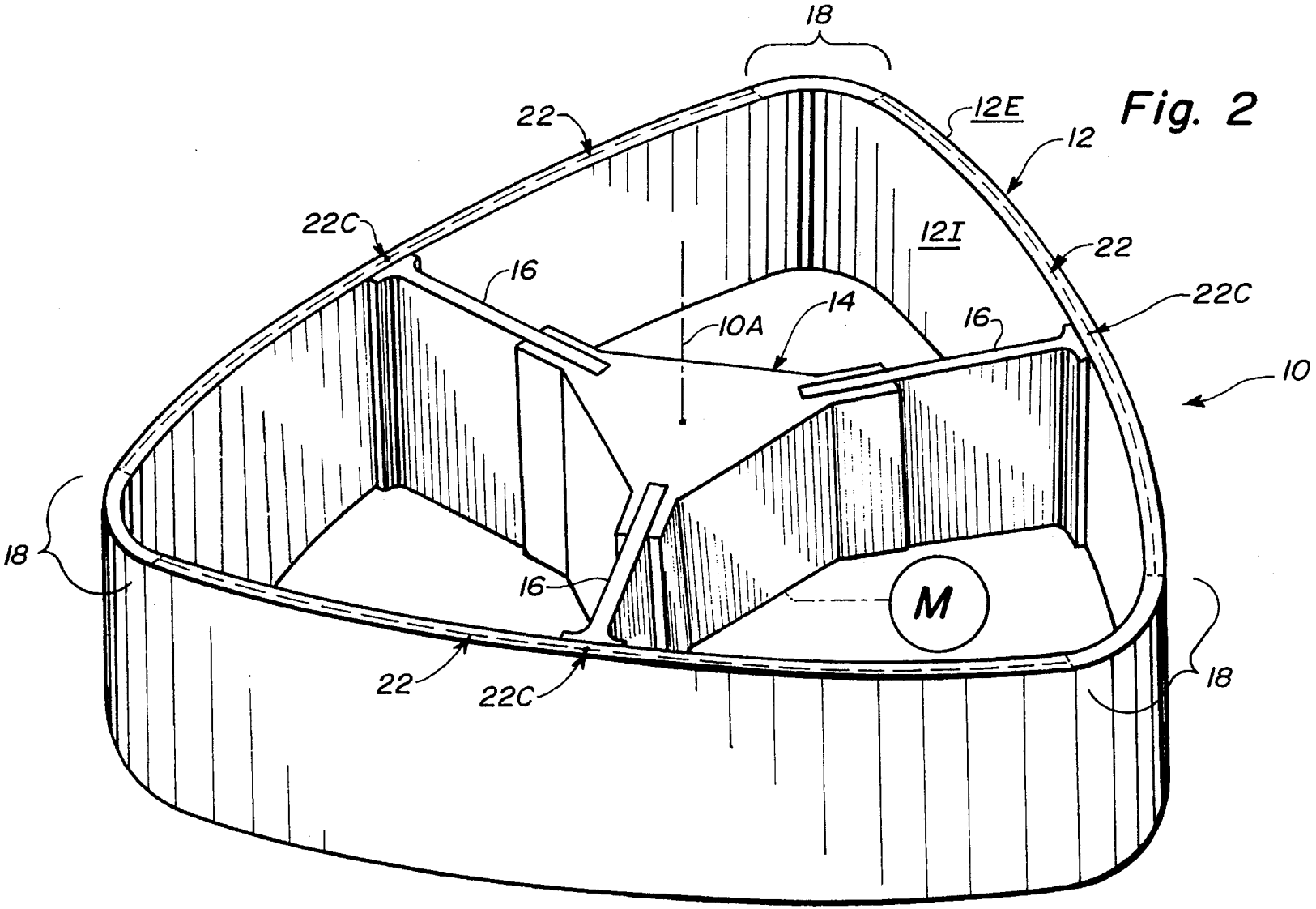
FIG. 2 is an isometric view of the rotor of FIG. 1.

Shown in FIGS. 1 and 2 are, respectively, a plan and an isometric view of a centrifuge rotor 10 having a peripheral applied load accepting band 12 in accordance with the present invention. The band 12 has a predetermined thickness dimension 12T associated therewith. (It is noted that in the derivation set forth in the Appendix, the thickness 12T of the band is indicated by the symbol "t".) The band also has an interior surface 12I and an exterior surface 12E thereon.

The rotor 10 includes a central hub 14 which may be connected, as diagrammatically illustrated in FIG. 2, to a suitable motive source M whereby the rotor 10 may rotate about its axis of rotation 10A. The central hub 14 has a plurality of radially outwardly extending struts 16. The hub and the struts may be formed from a composite, such as a reinforced plastic. The hub and the struts may alternately be formed of metal.

The peripheral band 12 is mounted to the struts 16 and surrounds the hub 14. The band 12 may be connected to the struts 16 by any suitable means, as will be described. The band 12 has a plurality of angularly spaced, applied load accepting regions 18 defined thereon, with the regions of the band circumferentially intermediate between the load accepting regions 18 being indicated by the reference character 20. The load accepting regions 18 are those locations on the band 12 where sample carriers 30 to be described (FIGS. 4 to 7) are attached to the band 12 or those locations where swinging bucket sample carriers 30 to be described (FIGS. 8 to 9) abut against the interior surface 12I of the band 12. The transition point between any one of the load accepting regions 18 and the region 20 adjacent thereto is indicated by the reference character 24.

Adjacent applied load accepting regions 18 are, in a plane perpendicular to the axis 10A (that is, the plane of FIG. 1), spaced apart a predetermined angular distance (2Θ), depending upon the number of the sample carriers 30 on the rotor 10. The angle (2Θ) is related to the number N of sample carriers disposed on the rotor 10, with (2Θ) (in degrees) being equal to 360 divided by N.

As will be developed the applied load accepting band 12 in accordance with the present invention is, during centrifugation, subjected to only tensile force, thereby eliminating therefrom regions of high stress concentration which may reduce band life. The applied load accepting band 12 may be fabricated either from a composite material or from a metal, such as aluminum or titanium. In the preferred instance the band is formed of a composite material. A band having a constant stress therein, that is fabricated from a homogeneous material, such as a metal, is disclosed and claimed in copending application Ser. No. 08/475,921, filed contemporaneously herewith. Considerations of economy of manufacture using a composite material dictate that the band formed therefrom exhibits a constant cross sectional area. Accordingly, in the discussion that follows, the composite Z band exhibits a cross section area that is constant along its entire periphery.

In addition to the generally functional definition set forth above, [i.e., a band that is structurally configured in such a way that, during centrifugation, the band is subjected only (or substantially only) to tensile force] the band 12 is susceptible to definition in terms of the mathematical definition of the shape of the band. For purposes of mathematical analysis in the derivation of the expressions that define the physical shape of the band, in the most general case the loads imposed on the band can be analyzed as if acting through a single point on the band. Also, in the most general case, the thickness of the band is neglected. The most general form of expression for the shape of the band is derived with these constraints in mind. It should, however, be appreciated that the band 12 has a finite thickness, and that the load accepting regions 18 in actuality extend some predetermined finite distance about the periphery of the band 12. Accordingly, as will also be developed herein, in a more specific aspect, the effect of the thickness of the band is considered in the derivation of the shape of the band intermediate the load accepting regions. Finally, in an even more specific aspect, the shape of the band both in the load accepting region 18 and in the region 20 immediately adjacent thereto is derived with considerations of the finite extent of the load accepting region and band thickness taken into account.

In accordance with most general aspect of the present invention now under discussion, in a plane perpendicular to the axis 10A of rotation of the rotor 10, the regions 20 of the applied load accepting band 12 intermediate the load accepting regions 18 have a predetermined equilibrium curve 22, indicated by the dashed line, defined therein. The equilibrium curve 22 is used herein as a definition of the shape of the span regions 20 of the band. Preferably the equilibrium curve 22 is construed to extend centrally through the thickness 12T of the band 12, that is, midway between the interior surface 12I and the exterior surface 12E thereof. However, it should be understood that the equilibrium curve 22 may be defined as extending through any radial location within the thickness of the band 12. The equilibrium curve 22 has a predetermined center point 22C therealong.

Figure 3B:
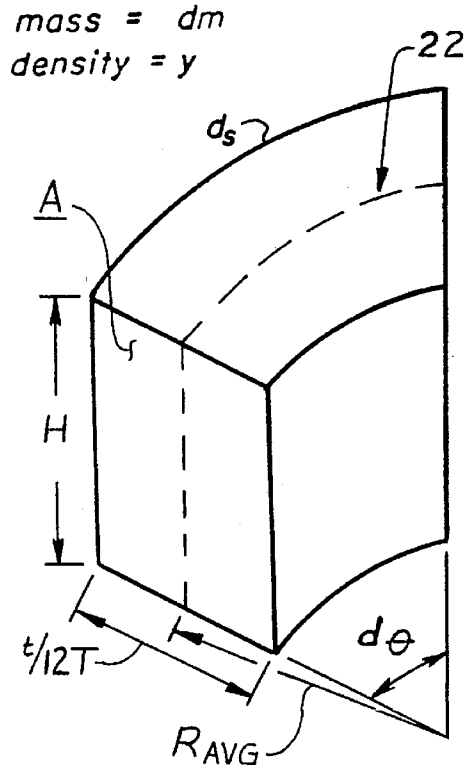
Figure 3A:
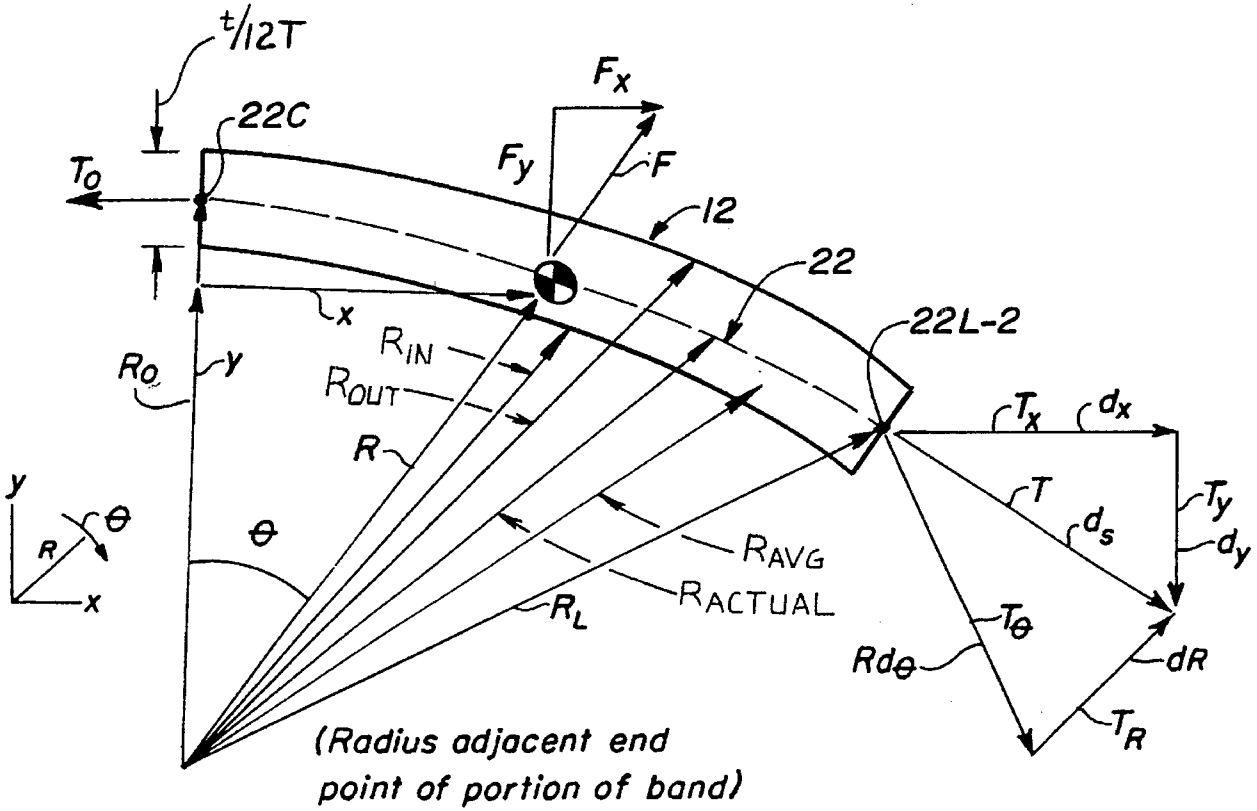

Each point on the equilibrium curve 22 lies, in the plane of FIG. 1 and the free body diagram of FIG. 3A, a predetermined radial distance R from the axis 10A. The distance from the axis 10A to the equilibrium curve 22 at the midpoint 22C is denoted by the reference character $R_0$ while the distance from the axis 10A to the equilibrium curve 22 at the applied load accepting regions is denoted by the reference character $R_L$. Since the adjacent applied load accepting regions 18 are spaced angularly a distance (2Θ), the angular distance between the radius $R_0$ and a radius R is denoted by the angle Θ. The transition point between any one of the load accepting regions 18 and the region 20 adjacent thereto is located at a transition radius $R_T$.

When the band 12 is removed from the struts 16 by which it is attached to the hub 14 and while the band 12 is at rest, the equilibrium curve 22 from the midpoint 22C to a point adjacent to either one of the applied load accepting regions 18 is defined by the relationship:

$$d(R/R_0)/d\Theta=(R/R_0)^2 RAD(1-\{K/2[(R/R_0)^2-1]\})^2-(R/R_0)^2 \quad (1)$$

$$K=[(\gamma\omega^2 R_0^2)\ (1/g)\ (1/\sigma_0)] \quad (2)$$

where

ω is the angular speed,

γ is the density of the band, g is the acceleration due to gravity,

σ is the stress per unit area in the band, where $R_0$ is the distance from the axis 10A to the midpoint 22C on the equilibrium curve 22 between two adjacent applied load receiving regions 18.

where K is a constant of curvature (shape factor) of the band that has values greater than zero and less than 1, such that 0<K<1.

It is noted that the symbol "RAD" is used throughout this application (including the Appendix) to denote the radical sign indicating the computation of square roots.

The derivation of Equations (1) and (2) is set forth in the Appendix, which is appended to and forms part of this application.

The constant K defines a shape factor K for each of the family of equations that satisfy the differential equation (1). Since the band is to be exposed only to a tensile force while spinning the shape factor K must be limited within the range 0<K<1. If K lies outside these limits an equilibrium condition is not possible. The physical explanation of the limits on K can be understood with reference to a consideration of the ranges of loads able to be accommodated by a band in accordance with the invention.

Figure 3D:
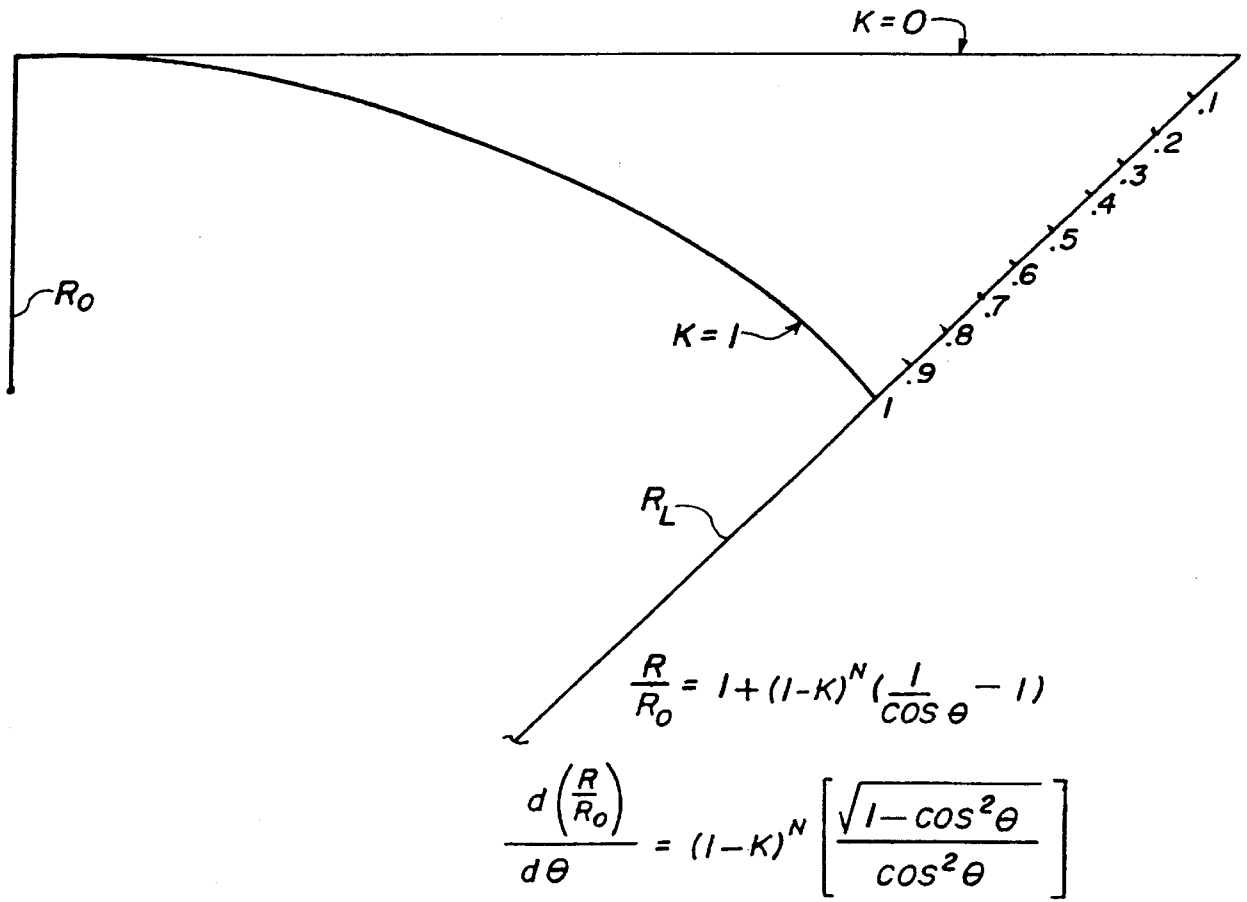

As seen in the drawing FIG. 3D the differential Equations (1) define a family of equilibrium curves. If the shape factor K=1, the equilibrium curve takes, the form of a circle. However, a circular form for the equilibrium curve would mean that a band having such an equilibrium curve has no component of band tension available to contribute to supporting a load applied to the band. A band subjected only to a tensile force while spinning would thus be able to accommodate zero load without bending—an impractical result. Thus to support a load a circular band must necessarily be subjected to bending.

If the shape factor K=0, the equilibrium curve takes the form of a straight line. In this instance a band having such an equilibrium curve has no component of band tension able to contribute to supporting the centrifugal force exerted on the mass of the band. Thus, a band having an equilibrium curve in the form of a straight line and being subjected only to a tensile force while spinning must have zero mass, a clearly absurd result.

Thus, a band in accordance with the present invention which is subjected only to tensile force while spinning must, of necessity, have an equilibrium curve in which the shape factor K lies within the range 0<K<1.

Any band in accordance with the present invention (that is, a band subjected only to tension while spinning) will exhibit an equilibrium curve between a midpoint of a band segment and a point on the band next adjacent to the applied load accepting region that closely matches one of the family of equilibrium curves defined by Equations (1) and (2) (or any other paired set of equations). It is again noted that since the load accepting regions 18 has some finite extent, the shape of an actual band may deviate from its equilibrium curve in the load accepting regions 18 when the shape of the load accepting region and the stresses due to radial thickness are ignored, and still remain within the contemplation of the invention.

Moreover, it should be understood that, within the portion of the band between the midpoint and the point adjacent to the applied load accepting region a band 22 may also approximate the mathematical definition of the equilibrium curve given by Equations (1) and (2) (or any other paired set of equations) and still remain within the contemplation of the present invention. To this end the equilibrium curve 22 may be viewed as a reference curve that defines a neutral or reference radial distance for each value of Θ. So long as a predetermined actual radial distance $R_{actual}$ of a band approximates the reference radial distance R as defined by the equations for the equilibrium curve, such a band is to be construed as lying within the contemplation of the present invention. Thus, the radial distances $R_{actual}$ in an actual band need not match the equilibrium curve of the equations point by point, so long as the band is generally loaded only by tension while spinning it is to be construed to lie within the contemplation of the invention.

Whereas the optimum performance is provided when the shape of the band matches the equilibrium curve and thus the stresses created by bending moments are equal to zero, it is recognized that some stress created front bending moments can be tolerated in the design of a centrifuge rotor which produces less than optimum performance. Consequently, bands which approximate the equilibrium curve must also be construed as lying within the contemplation of this invention.

To determine that the equilibrium curve of a band in an actual rotor the band is first removed from the struts that affix it to the hub. The contour of the actual band may then be plotted. If the band is exposed only to tension when spinning, the equilibrium curve of the band will closely match one of the family of equilibrium curves shown in FIG. 3D. That is, the equilibrium curve of the band from the actual rotor will fall on one of the family of curves in the range between $R_0$ and $R_L$ or will lie within a predetermined range of one of the family of equilibrium curves.

To verify that such a band is subjected to only a tensile force, a brittle lacquer test may be performed (preferably prior to the disassembly of the rotor from the struts, as discussed above). The brittle lacquer test is discussed in Richard C. Dove and Paul H. Adams, "Experimental Stress Analysis and Motion Measurement", Charles E. Merrill Books, Inc., Columbus, Ohio (1964). Other tests to verify that the band is subjected only to tensile forces could be performed. Such other testing could include the mounting of strain gauges on inside and outside radial surfaces of the band or the use of photographic techniques. In such photographic techniques, the rotor is rotated at its design speed with the sample carriers 30 carrying the maximum rated (i.e., design) load in a centrifuge fitted with a clear lid. A camera, such as thirty-five millimeter camera, is mounted directly above the rotor, centered on the axis of rotation. One or more flash units, each for example having a maximum flash duration of 0.5 microseconds, are mounted to illuminate the rotor when the flash unit(s) are activated by the camera shutter release. A photograph is exposed, is capturing the image of the spinning rotor on high speed film. The shape of the band 12 on this photograph can then be compared to the equilibrium curve defined by any of the paired sets of equations given herein for the parameters of the band and its loading conditions.

A band 12 having a configuration that satisfies the equilibrium curve 22 of Equations (1) and (2) will be subjected only to tensile force while spinning. The shape of the band 12 will not change while the band is accelerating to or rotating at speed. However, the band 12 may grow outwardly, and the sample carriers 20 affixed to the band may displace radially outwardly, both movements due to centrifugal force effects. However, the loads imposed on the band 12 due both to its weight and to the weight of the load, will be balanced by the tensile force in the band. Thus, the band will undergo no bending stresses. The operating size of the band 12 can be accurately predicted from the tension in the band and the modulus thereof. The equilibrium curve that defines the band when operating at design speed and at design loading conditions may hereafter be referred to as the design equilibrium curve or the design equilibrium shape.

When the band 12 is fabricated from a composite material a suitable material is a tape formed of a plurality of uniaxial fibers surrounded by a thermoplastic matrix, such as polyether ketone ketone (PEKK) or polypropylene. The fiber can be an aramid fiber such as that manufactured and sold by E. I. DuPont de Nemours and Company under the trademark "KEVLAR" or carbon and graphite fiber, including pitch and polyacrylonitrile (PAN)-based materials, and sold in continuous, chopped, mat, and woven forms: and carbon fiber preimpregnated with an epoxy resin under the Registered Trademark "THORNEL" owned by Union Carbide. The band 12 is formed by filament winding using either tow or tape on a mandrel that has a predetermined shape that corresponds to the equilibrium curve 22. As the tape is wound on the mandrel, the resulting band has imparted thereto the shape of the equilibrium curve. The band 12 so formed has a generally constant radial or thickness dimension. In addition, the band 12 (or the band 12' to be discussed) can be fabricated as an injection molded or as a compression molded composite formed of a plastic material, such as nylon reinforced with chopped fiber (e.g., glass filled nylon).

It should also be noted that a band having a constant cross section may also be formed from a homogeneous material, such as titanium or aluminum.

As illustrated in FIG. 1 and 2, the struts 16 are attached to the interior surface 12I of the band 12 at the midpoints 22C along the equilibrium curve 22. It should, however, be understood that in accordance with any definition of the invention herein given (i.e., whether the band is defined generally functionally or in terms of any paired set of equations the strut 16 may be attached to the band 12 at either at the center point 22C of the equilibrium curve 22 or at the load accepting regions thereof.

Figure 1A:
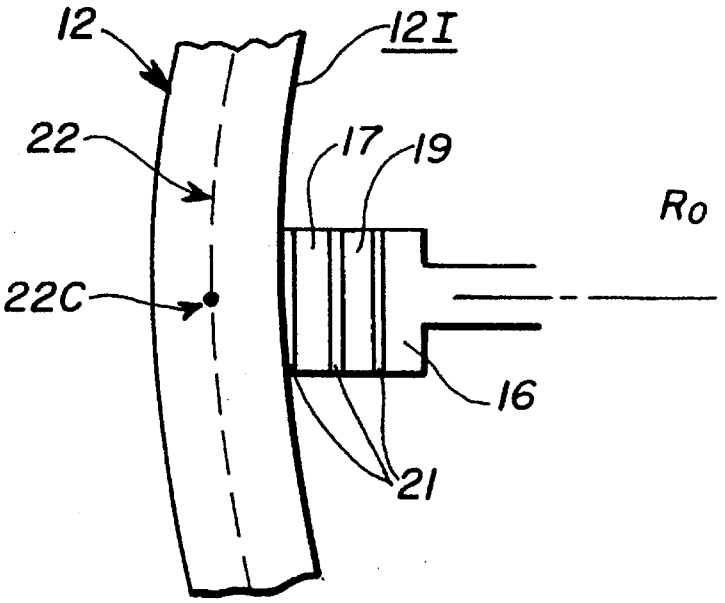
FIG. 1A is an enlarged view of a portion of FIG. 1 illustrating the attachment of the strut to the band.

As seen in the enlarged view of FIG. 1A, proceeding radially inwardly from the interior surface 12I of the band at the desired mounting location to the radially outer surface of the strut 16 is an elastomeric sheet 17 and a layer 19 of a composite material. A suitable adhesive layer 21 is disposed between the interior surface 12I of the band 12 and the elastomeric sheet 17, between the elastomeric sheet 17 and the layer 19 of composite material, and between the layer 19 of composite material and the strut 16. The elastomeric sheet 17 is provided to accommodate shear to limit strain in the adhesive layers 21, while the composite layer 19 is provided to accommodate stress in the transverse direction. Any suitable adhesive compatible with the materials being adhered may be used.

In practice, the struts 16 may preload the band slightly, in order to accommodate variations in the radial stiffness of the band 12 and the strut 16. This preload may deform the shape of the band while it is attached to the struts from the shape corresponding to the equilibrium curve. Deformation due to the preload is, however, a elastic deformation. It should thus be clearly understood that it is the shape of the band when the same is removed from the struts and is at rest that meets, as discussed above, the relationships set forth in Equations (1) and (2) (or any other paired set of equations) and thus falls within the scope of the present invention. Due to the preload, when assembled on the struts and at rest, the band imposes a first predetermined compressive (i.e., radially inwardly directed) force on the struts. However, while the band is spinning, the band grows due to centrifugal force effects and the band imposes a predetermined lesser compressive force on the struts.

It should be recognized that the design equilibrium curve can only be obtained when the bending stresses are equal to zero. In use, it is beneficial to provide some preload of the band against the strut in order to compensate for differences in radial stiffness and the associated differences in deformation when the rotor is rotated. By design, the equilibrium shape will only be obtained in this case when the rotor reaches the design speed and contains the design load. At zero speed the bending stresses due to the preload are at a maximum. As the rotor increases speed the bending stresses created by the preload decrease while the stress created by the load increase. When the rotor reaches the design speed the bending stress created by the preload is zero and the band is totally in tension due to the load. At this point the band obtains the design equilibrium curve.

—o—O—o—

As noted, a band 12 having a shape in the regions 20 between load accepting regions 18 that is defined or approximated by Equations (1) and (2) exhibits the most general form of the equilibrium curve. To reiterate, in generating the most general form of the equilibrium curve for the region 20 between the load accepting regions, the load accepting regions are treated as a point, and, the thickness 12T of the band is neglected. However, as a first refinement to the analysis, it is recognized that the thickness 12T of the band imparts a stress that must be considered.

Body forces acting on the band 12 result in essentially equal radial displacement of the inner surface 12I and outsides surface 12E. However, since the inner surface 12I has a smaller circumferential length its tangential strain (and therefore stress) will be greater than that of the outer surface 12E. In an actual band of finite thickness 12T there would be a tangential strain differential between the inside and outside surfaces. If the shape of the band 12 is configured in such a way as to generate a Compensating Moment which compensates for the strain differential inherent in a band of a finite thickness, the band 12 a more optimally shaped band may be defined wherein the strain differences are minimized.

Thus, in accordance with a more detailed aspect of this invention, a band 12 that exhibits, in the region 20 intermediate adjacent load accepting regions 18, a shape defined by or approximating the relationships given in the paired set of Equations (1A), (2A), will have a Compensating Moment generated therein. These relationships are:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

where $$K=[(\gamma\omega^2R_0^2)\ (1/g)\ (1/\sigma_0)] \quad (2)$$

and where R is the distance from the axis 10A to the equilibrium curve 22, $R_0$ is the distance from the axis 10A to the midpoint 22C on the equilibrium curve 22 between two adjacent applied load receiving regions 18, ω is the angular speed, γ is the density of the band, g is the acceleration due to gravity, and $\sigma_0$ is the stress per unit area in the band, and t is the thickness of the band.

Equation (1A) defines the equilibrium curve of the band between the load regions modified to accommodate the thickness of the band taking into account the Compensating Moment. It should be noted that as the thickness (t) approaches Zero, the compensating moment will also approach zero, and Equation (1A) then reverts to the form of Equation (1) (in which the thickness t is neglected).

—o—O—o—

In an even more detailed aspect the present invention relates to a load accepting band wherein the load accepting region has a finite circumferential length and wherein the Compensating Moment that compensates for bending stresses introduced into the band due to its thickness is accommodated both in the region 20 between the load accepting region and also within the load accepting region 18. In such an instance the band in the load accepting regions approximates the shape determined by the following paired set of equations defined by Equations (1B) and the set of Equations (2B):

$$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=\{ZR_L+[t^2/((6(2R_L-t))]\}/\{R_L+[t^2/((6(2R_L-t))]\}$$

$$K_1=[(\gamma\omega^2R_L^2)\ (1/g)\ (1/\sigma_0)]$$

$$K_2=[(R_2\sigma_cH)/T_0] \quad (2B)$$

where $Z=R_0/R_L$ t is the thickness 12T of the band, and where R, $R_0$, ω, γ, g, and $\sigma_0$ are as defined earlier.

Equation (1B) and the set of equations indicated by the character (2B) represent the optimized equilibrium equation for the band in the load accepting regions. The region of the band spanning the load accepting regions is defined by or approximates the shape determined by the following paired set of equations:

$$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1} \quad (1BB)$$

where $$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)]$$

$$K_2=[(R_2\sigma_cH)/T_0] \quad (2B)$$

where $Z=R_0/R_L$ and where t, R, $R_0$, ω, γ, g, and $\sigma_0$ are as defined earlier.

The Load Ratio may be determined geometrically, as set forth above, or by using the brittle lacquer test, as herein defined.

—o—O—o—

A band 12 in accordance with the present invention, whether implemented in a composite material or a homogeneous material, and whether defined or approximated by any of the relationships set forth above, may be used in any of a variety of centrifuge rotors, as will be appreciated from FIGS. 4 through 9.

Figure 5:
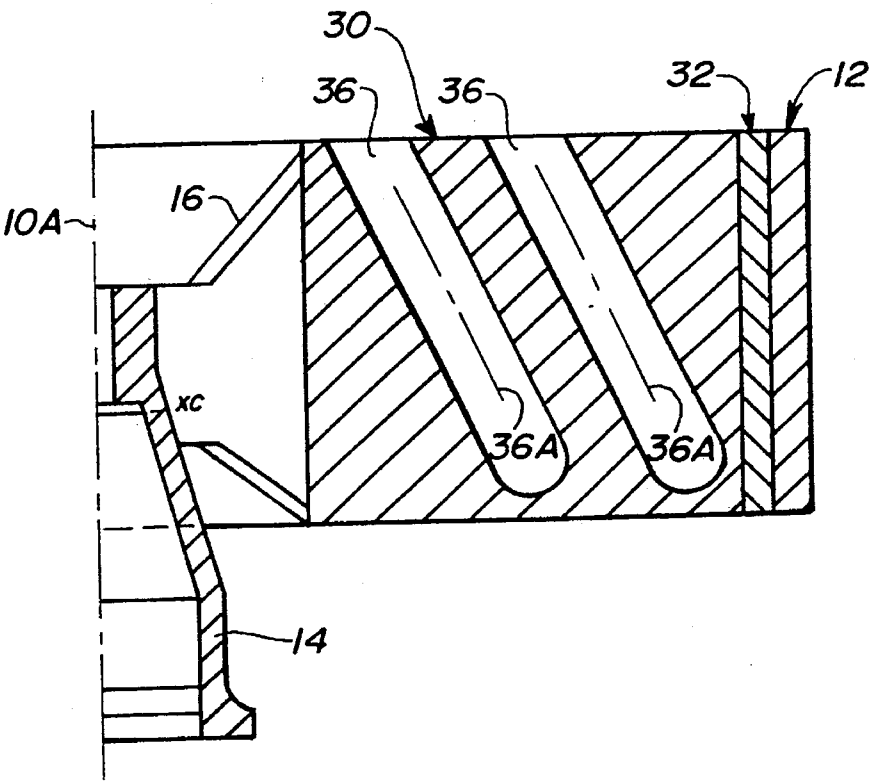
FIG. 4 and 5 are, respectively, a plan view and a side elevational view taken along section lines 5—5 in FIG. 4 illustrating a fixed angle centrifuge rotor having an applied load accepting band in accordance with the present invention.
Figure 4:
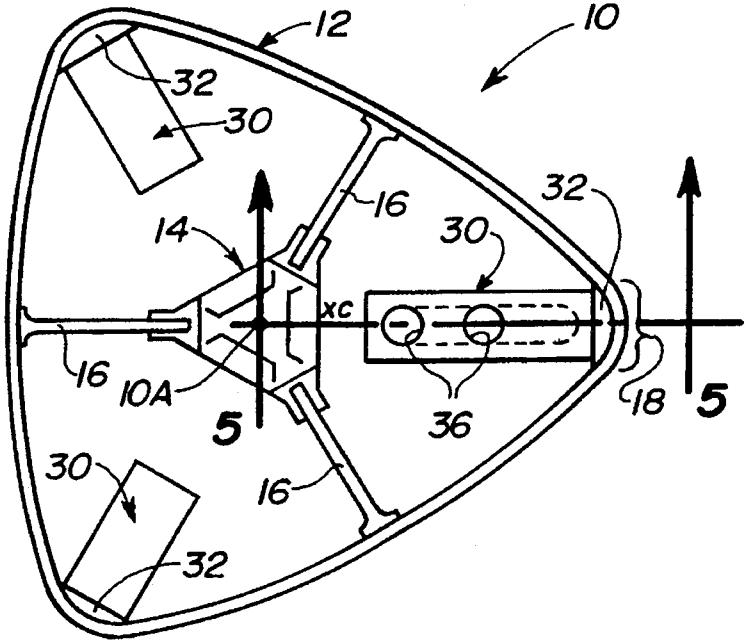
Figure 7:
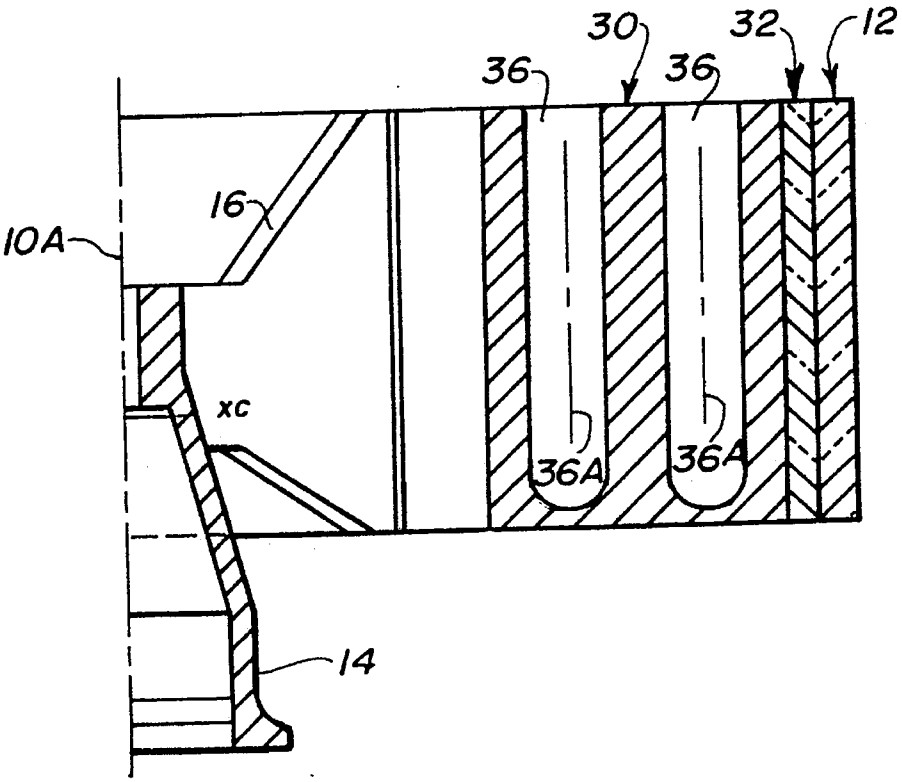
FIGS. 6 and 7 are, respectively, a plan view and a side elevational view taken along section lines 7—7 in FIG. 6 illustrating a vertical centrifuge rotor having an applied load accepting band in accordance with the present invention.
Figure 6:
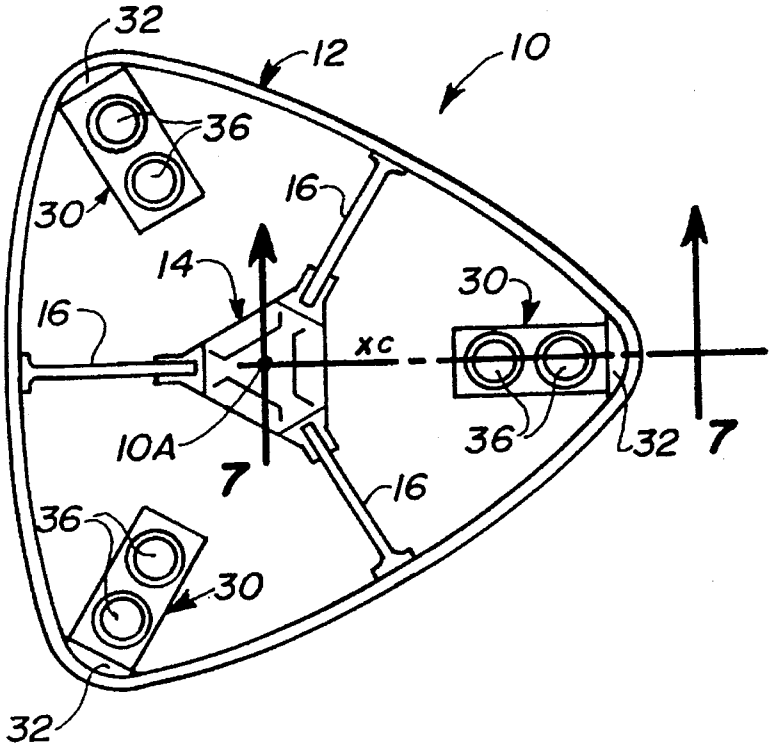

FIGS. 4 and 5 illustrate a plan and a vertical cross section view of a rotor 10 having a band 12 in accordance with the present invention in which the sample carriers 30 are configured to define a fixed angle centrifuge rotor. In this instance each of the sample carriers 30 is attached directly to and supported by the band 12 at an applied load accepting region 18. The carrier 30 is mounted to a load transition pad 32 that is attached to the band 12 at the applied load accepting region 18. As seen in FIGS. 4 and 5 the sample carriers 30 have sample container receiving cavities 36 therein. Although two such cavities 36 are illustrated, it should be understood that any convenient number of cavities 36 may be so formed in the carrier 30. In the embodiment of FIGS. 4 and 5, the axis 36A of each cavity 36 is inclined with respect to the axis of rotation 10A. Alternatively, in FIG. 6, the axis 36A of each cavity 36 is parallel to the axis of rotation 10A, and a rotor of the vertical type is thus defined.

Figure 6A:
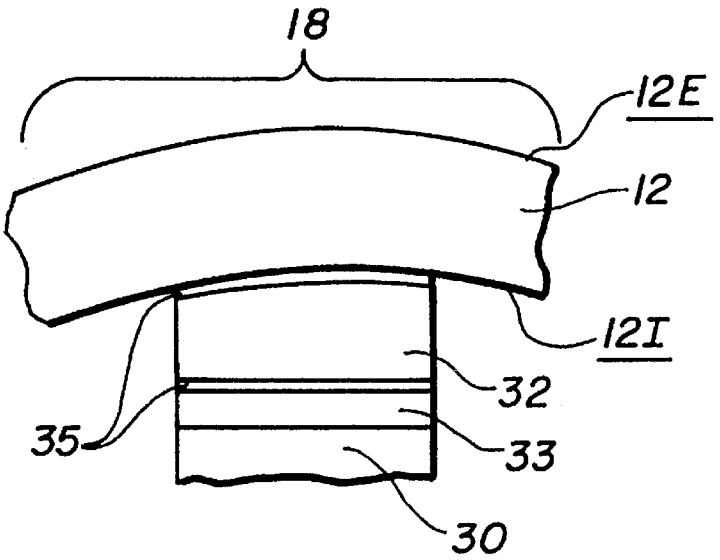
FIG. 6A is an enlarged view of a portion of FIG. 6 illustrating the attachment of the sample carrier to the band and the structure of the load transition pad.

In FIGS. 4 through 7 the sample carriers 30 are fabricated from a molded plastic material. In these same Figures (as well as FIGS. 8 and 9) the load transition pads 32 are formed from a molded elastomeric material such as polyurethane. As seen in FIG. 6A the pad 32 is attached to the interior surface 12I of the band 12 using an adhesive layer 35 similar to the adhesive layer 21. A composite member 33 is attached to the radially inner surface of the pad 32 by another similar adhesive layer 35. The radially inner surface of the composite member 33 is flat, while the radially outer surface of the pad 32 conforms in shape to the interior surface 12I of We band 12 in the load accepting region 18 where the pad is mounted. The sample carrier 30 may be attached to the member 33 using another layer 35 of adhesive, or the carrier 30 may be nested between the hub 16 and the member 33.

Figure 8:
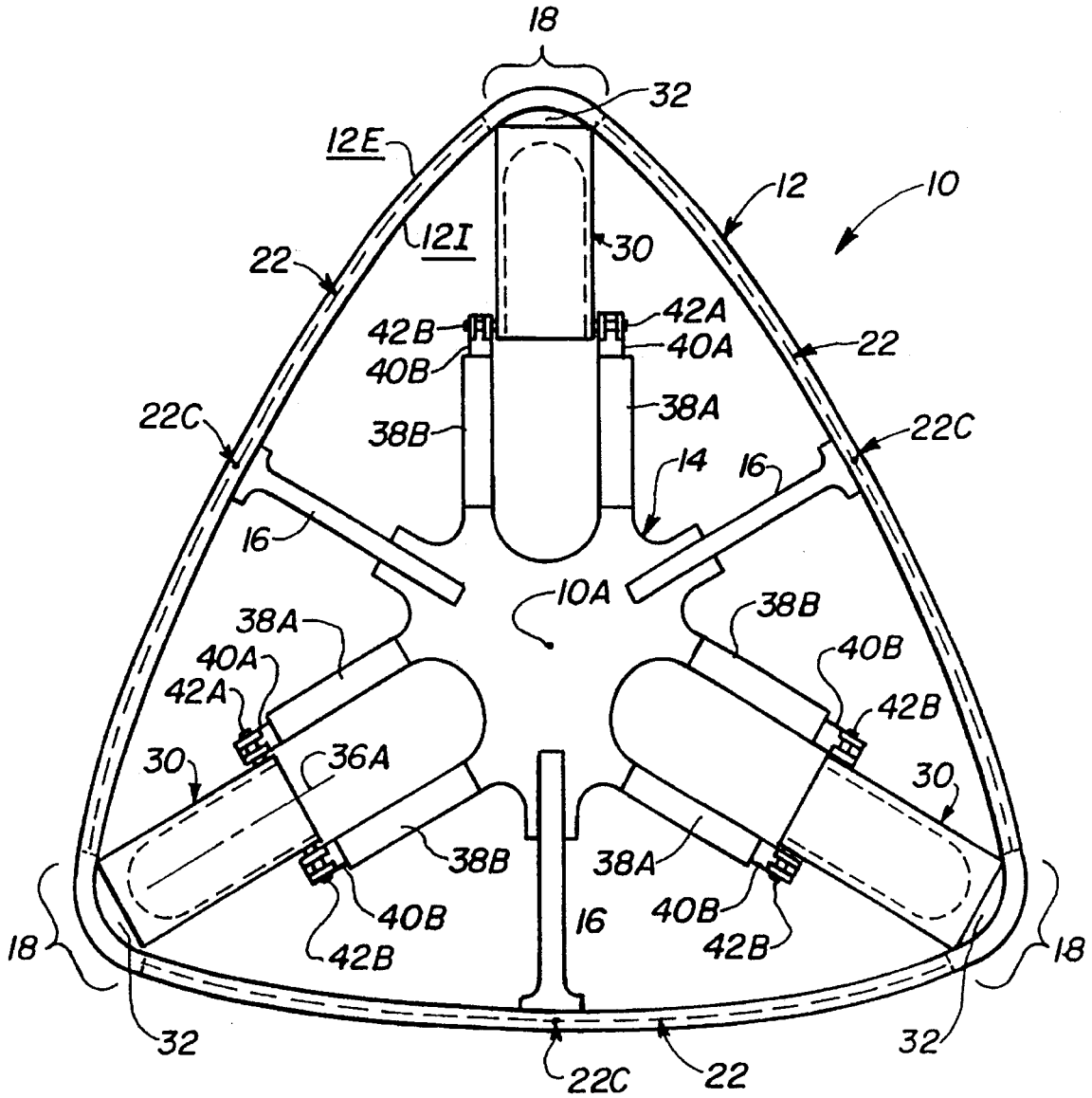
FIG. 8 and 9 are, respectively, a plan view and an isometric view illustrating a swinging bucket centrifuge rotor having an applied load accepting band in accordance with the present invention.
Figure 9:
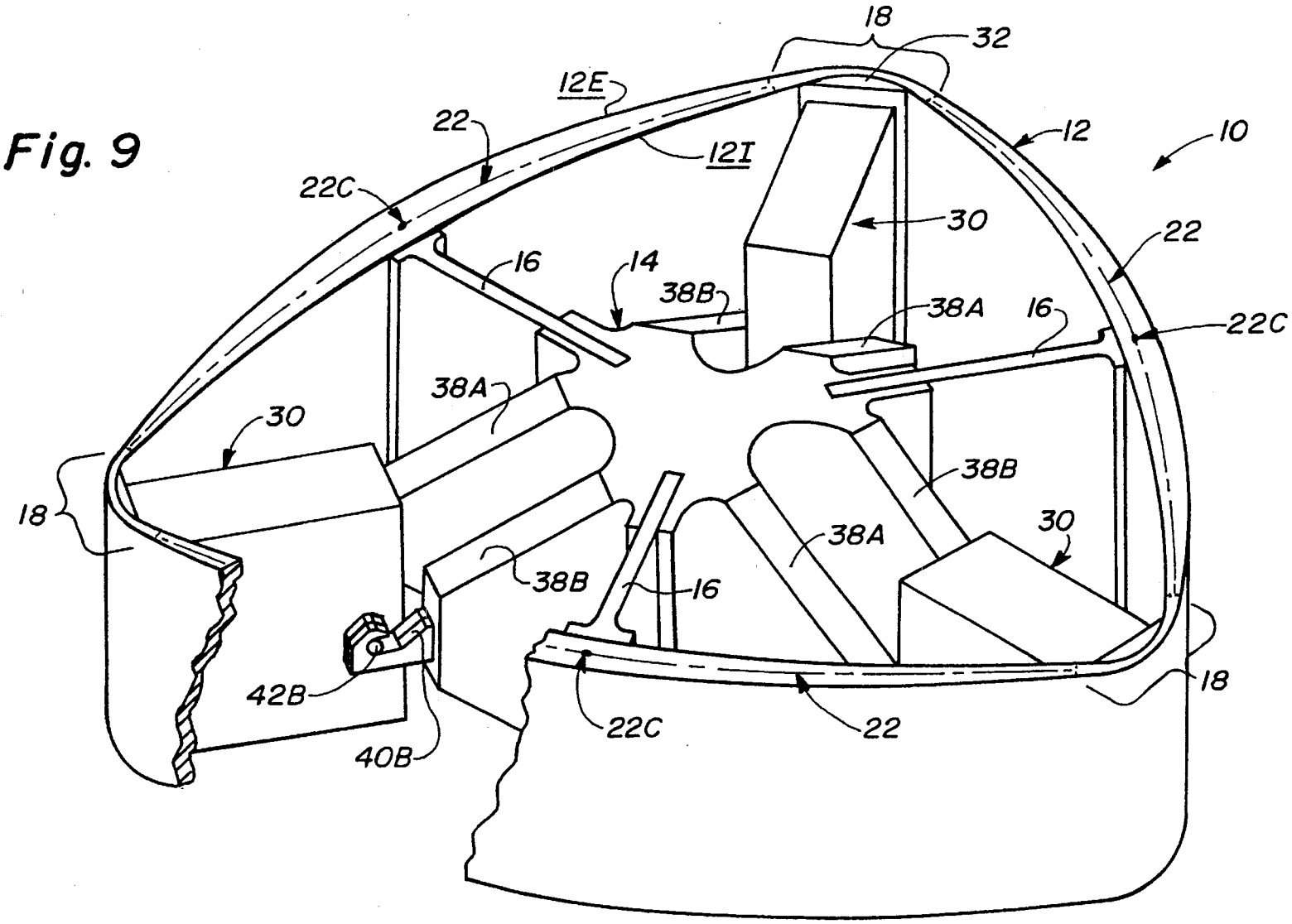
Figure 10:
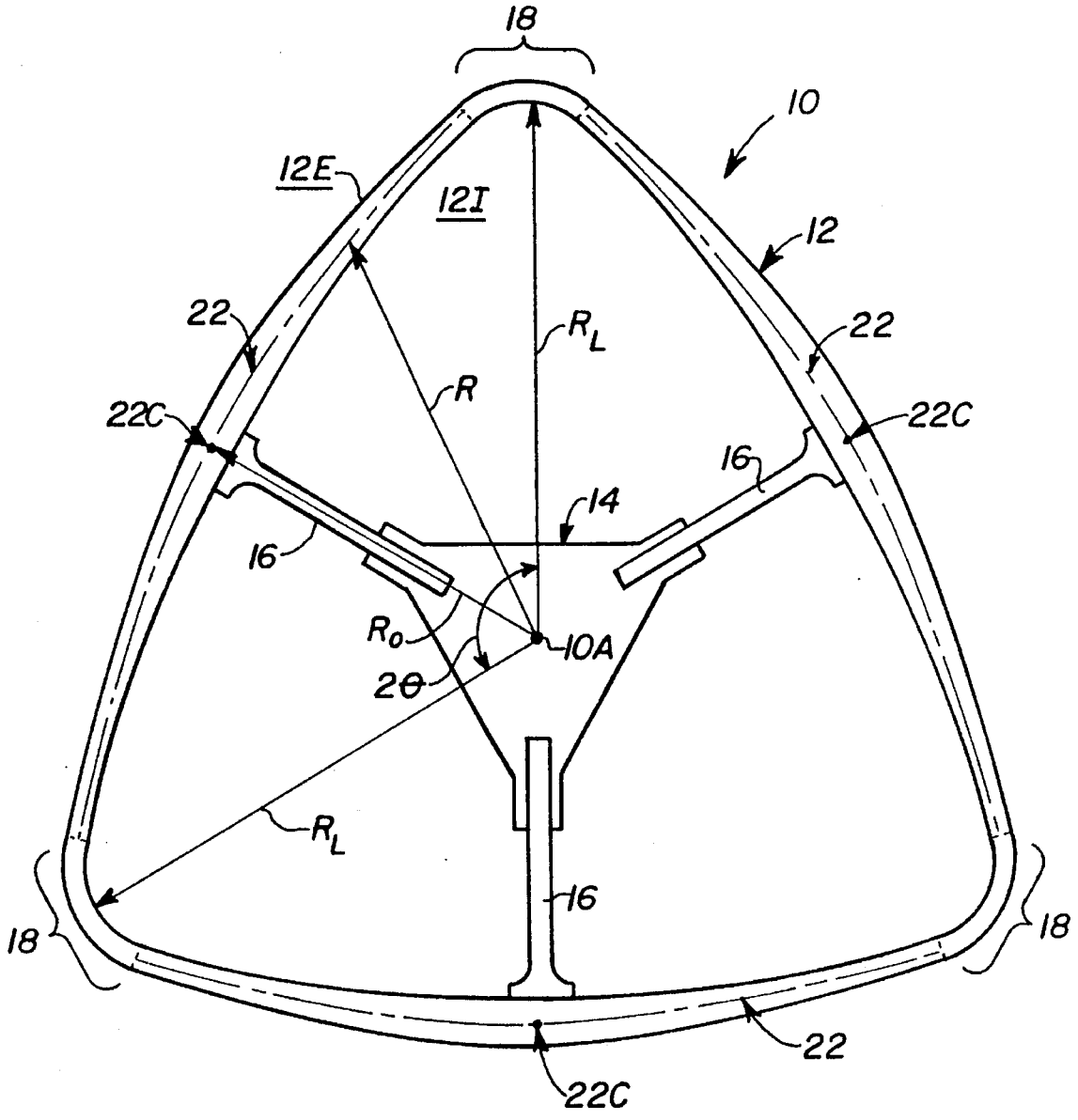
FIG. 10 is a plan view similar to FIG. 1 showing an applied load accepting band having a variable cross sectional area in accordance with the present invention.

As yet another alternative, as seen in FIGS. 8 and 9, the sample carriers 30 may be of the swinging type. To this end, the carriers 30 are thus pivotally mounted to the hub 14 so that during centrifugation the axis 36A of the cavities 36 move from a first, generally vertical, position to a second position. In the second position the axis 36A of each cavity 36 in the sample carrier 30 lies in a plane generally perpendicular to the axis of rotation 10A. Moreover, means 38 are provided whereby the end of the sample carrier 30 moves radially outwardly to its supported position against the pad 32 located in the applied load receiving region 18 on the band 12.

The pivotal mounting of the carrier 30 with respect to the hub 14 may be effected in a variety of ways. In the embodiment shown in FIGS. 8 and 9, the hub 14 is provided with angularly spaced pairs of radially extending arms 38A, 38B. Each arm 38A, 38B has a slot 40A, 40B therein that serves to accept a trunnion pin 42A, 42B disposed on the carrier 30. Of course the arms 38A, 38B could each carry a trunnion pin that is received in the carrier 30.

—o—O—o—

In the rotor heretofore discussed the struts 16 are attached to the interior surface of the band 12 at the midpoints of the band 12 between load accepting regions 18. The connection of the struts 16 to the band 12 is effected using the elastomeric sheet 17 and the layer 19 of composite material disposed between the radially outward end of the struts 16 and the interior surface 12I of the band 12. These layers accommodate shear and transverse stress resulting from relative movement between the band and the strut.

The relative motion between the band 12 and the strut 16 is the result of two actions. First, the band stretches during operation due to the tensile loading it supports, while the connection surface of each strut remains the same circumferential length as at rest. The change in length of one surface with respect to the other connected surface causes this relative movement. Second, any difference in the load applied at adjacent load accepting regions tends to change the shape of the band. The strut 16, attached to the midpoint of the band 12 between the load accepting regions 18, resists this change of shape. The resistance of the strut 16 to the change of shape of the band 12 leads both to shear at the connection of the strut to the band and to bending of the strut towards the larger load. Normal variances in the volumes of sample from one sample carrier to another can lead to this difference in loading.

Figure 12:
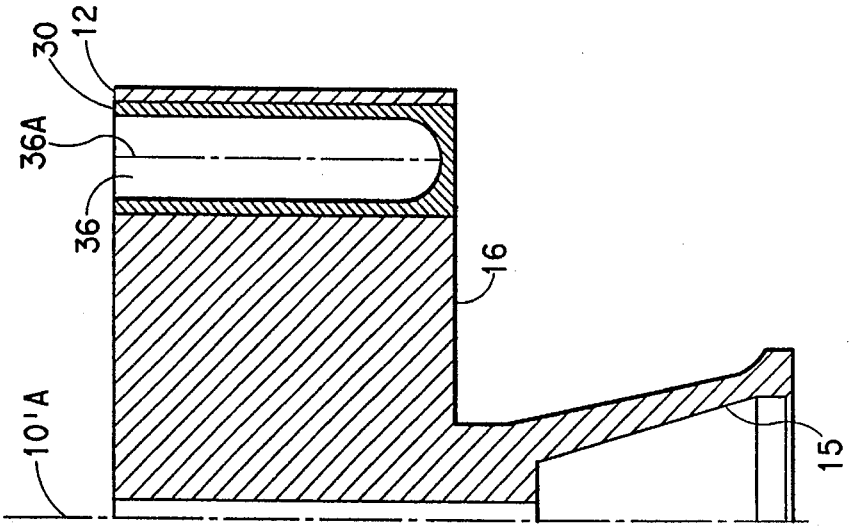
FIG. 12 is cross sectional view of the rotor of FIG. 11 taken along section lines 12—12 therein.
Figure 11:
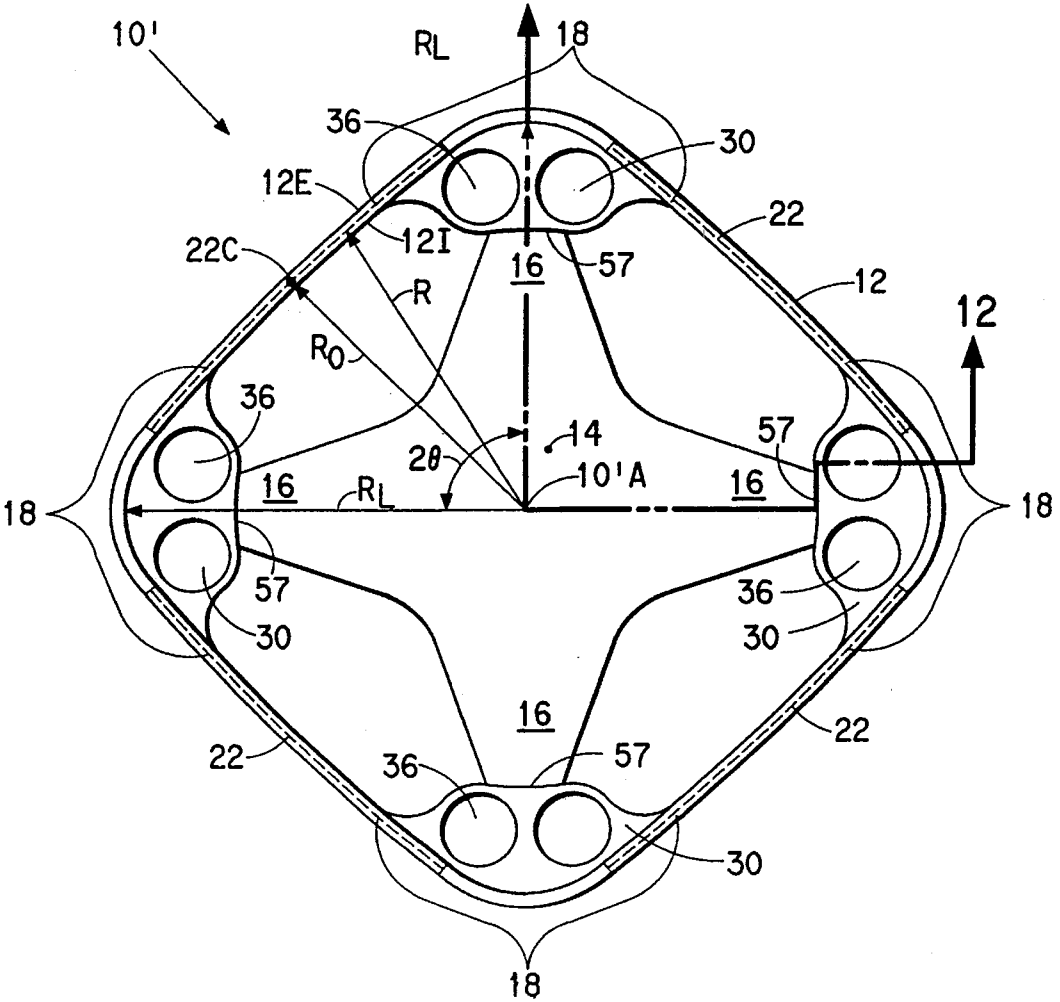
FIG. 11 is a plan view of a centrifuge rotor having an applied load accepting band in accordance with the present invention in which sample carriers of the vertical type are disposed at load accepting regions of the band and in which the mounting struts are attached to the sample carriers.

FIGS. 11 and 12 are, respectively, a plan and a vertical cross-sectional view of a rotor 10' in which such shear and bending in the struts 16 are eliminated. The rotor 10' has a peripheral load accepting band 12 in accordance with the present invention. The band 12 again has a predetermined thickness associated therewith and has an interior surface 12I and an exterior surface 12E thereon. The composition and thickness of the band are determined by identical considerations as were developed previously. An alternate form of load accepting band 12' is illustrated and discussed in connection with FIG. 13.

The rotor 10' includes a central hub portion 14 having a mounting recess 15 formed therein by which the hub 14 may be connected to a suitable motive source. An axis of rotation 10'A. extends through the central hub portion 14. A plurality of struts 16 extends radially outwardly from the hub 14. Similar to the embodiment previously described, the hub 14 and struts 16 are made from a composite material, such as a reinforced plastic, although they may be formed of metal.

The band 12 has a plurality of angularly spaced, applied load accepting regions 18 defined thereon. These regions 18 are those locations where sample carriers 30 or load transition pads 32 (FIGS. 17 and 18, for swinging bucket rotors) are attached to the interior surface 12I of the band 12. In a plane perpendicular to the axis 10'A, that is, the plane of FIG. 11, adjacent applied load accepting regions 18 are spaced apart a predetermined angular distance (2Θ). The angle (2Θ) is related to the number N of sample carriers 30 or load transition pads 32 disposed on the rotor 10'. The angular distance (2Θ) in degrees is equal to 360 divided by N.

The sample carriers 30 and the load transition pads 32 are attached to the band 12 at the load accepting regions 18. However, in accordance with the embodiment of the rotor shown in FIGS. 11 through 18, the struts 16 are connected to sample carriers 30 or to the load transition pads 32, as the case may be. Thus, the radially outward ends of the struts 16 lie at the load accepting regions 18. In the rotor shown in FIGS. 1 to 10 the radially outward ends of the struts 16 are attached to the band 12 at the midpoint thereof between adjacent load accepting regions 18.

Identical to the rotors previously described (FIGS. 1 to 10), when removed from the struts 16 and viewed in the plane perpendicular to the axis 10'A, the applied load accepting band 12 has a shape that follows the predetermined equilibrium curve 22 between adjacent load accepting regions 18. The shape of the equilibrium curve 22 from the midpoint 22C to a point adjacent the nearest applied load accepting region 18 is defined by the relationships of Equations (1) and (2), (or by the more detailed relationships given in other paired sets of equations).

Figure 18:
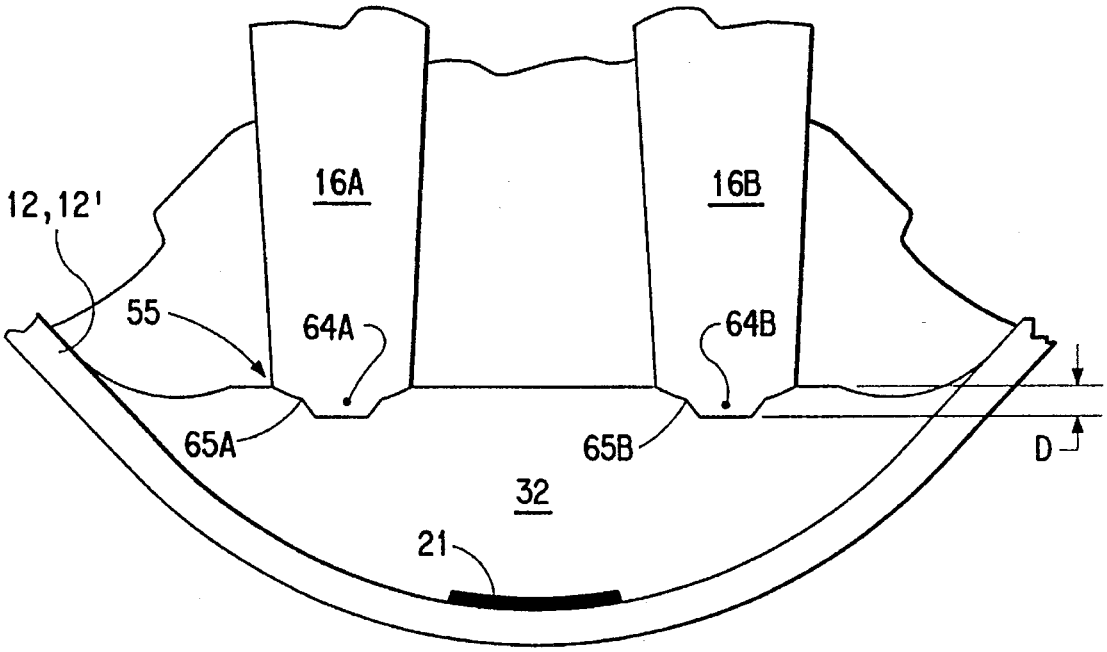
FIG. 18 is an enlarged view of a portion of the rotor shown in FIG. 17 illustrating the attachment of the load transition pad to the band at an applied load accepting region thereof and of the attachment of the strut to the load transition pad.

Each strut 16 is mounted to the band 12, 12' at an applied load accepting region through a connection 55 which is preferably incapable of supporting a tension load. The connection 55 is able to support compression and transverse loads. In the embodiment of FIGS. 11 to 16 the connection of the struts 16 to the band 12, 12' is implemented through the interface 57 between the struts 16 and the sample carriers 30. In the embodiment of FIG. 17 and 18 the connection is implemented through the interface 57 between the struts 16 and the pads 32. The interface 57 between the struts and the carriers 30 or the pads 32, as the case may be, in the preferred case supports compression but not tension. The advantage of such an interface 57 which can support only compression is described later.

In order to insure that the end of the strut 16 and the sample carrier 30 or the pad 32 remain in contact during normal operation of the rotor, the design equilibrium,curve of the band 12, 12' is selected such that the inside surface of the sample carrier 30 or the pad 32 does not lie radially outside of the location of the end of the strut 16 at design speed. If the design location of the Sample carrier 30 or the pad 32 exactly matches the design location of the end of the strut then there will be neither a separation between the strut 16 and the carrier or the pad nor a compression load on the strut at design speed and loading conditions. In the preferred case, as is developed below, the design equilibrium curve is selected such that the compressive load approaches zero at the design speed and at design loading conditions.

The struts 16 are in the preferred case pre-loaded by the band 12 when the band 12 is assembled on the struts 16. In the thus assembled rotor 10', the magnitude of this compression force is a maximum while the rotor is at rest and a minimum, preferably approaching zero, when the rotor is at its, design speed. The diminution in compression occurs as the band approaches the design equilibrium shape.

Figure 14:
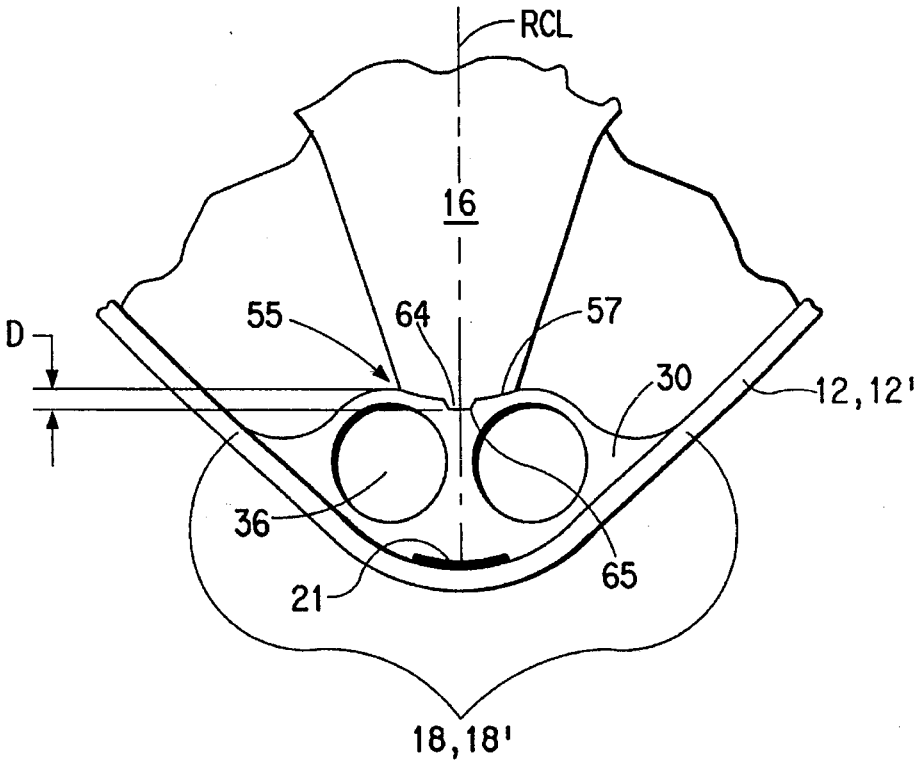
FIG. 14 is an enlarged view of a portion of the rotor shown in both FIGS. 11 and 13 illustrating the attachment of a sample carrier to the band at an applied load accepting region thereof and of the attachment of the strut to the sample carrier.

Providing an interface 57 between the strut 16 and the sample carrier 30 or the pad 32 which supports only compression (i.e., is not able to support a tension load) provides the advantage of limiting the top speed physically attainable by the rotor to a predetermined safe level. As noted, the pre-load compression applied by the band 12, 12' on the struts 16 can be controlled through the band design to approach zero at the design speed. Should, due to operator or machine error, the rotor be accelerated to a speed higher than the rated speed, the compression force will disappear and a gap between the strut 16 and the sample carrier 30 or the pad 32 will form. Referring to FIGS. 14 and 18, should this gap exceed the interference distance D between the strut 16 and the sample carrier 30 or the pad 32, the strut 16 will no longer be capable of accelerating the rotor to a higher speed. As a result the possibility of an extreme overspeed condition with the associated high energy levels and possible safety hazards is eliminated.

The sample carriers 30 and the load transition pads 32 are constructed of a material that is preferably light in weight and of a high compressive strength. Suitable for use in constructing the carriers 30 and the pads 32 is a graphite filled thermoplastic material such as the synthetic thermoplastic resins for molding and extrusion purposes sold under the Registered Trademark NORYL GTX owned by General Electric Corporation. The compressive strength of the material used to form the carriers 30 or the pads 32 must be high enough to support the compressive pre-load that is exerted on these members. High compressive strength is also required to support the load exerted by any sample on the sample carriers 30 during centrifugation. Light weight is preferable in order to minimize the load exerted by the sample carriers 30 (and the load transition pads 32 in the swinging bucket case) on the band 12, 12' during operation of the rotor 10'.

Each sample carrier 30 may be provided with one or more cavities 36 which can support one or more sample containers. Conventional rotors have equally spaced sample containers around the rotor. (The angular distance between each of C containers is equal to 360 degrees divided by C.) In the rotor 10, 10' of the present invention, where two or more containers can be accommodated in each sample carrier 30 (for example, FIGS. 11 and 12) the container(s) are clustered in the load accepting regions 18, 18' of the band 12, 12'.

In an assembled rotor the sample carriers 30 and the load transition pads 32 may be held in place between the end of the struts 16 and the interior surface of the band 12, 12' only by the compression force exerted by the pre-loaded band. However, in practice, it may be desirable to dispose a narrow stripe 21 of adhesive between the sample carriers 30 or the load transition pads 32 and the band 12, 12'. In FIG. 14 the stripe 21 of adhesive is shown as a thickened line. The stripe 21 of adhesive should lie along the radial centerline RCL, of the load accepting regions 18, 18'. The adhesive holds the sample carriers 30 or the load transition pads 32 in place against the band 12, 12' prior to mounting the band on the struts. The adhesive should not extend over the entire interface between the sample carriers 30 or the load transition pads 32 and the band 12, 12' due to the tendency of the adhesive to inhibit relative motion between the adhered member and the band during centrifugation, therefore introducing additional stress into the band.

With a band 12 that exhibits a shape defined by the relationships of Equations (1) and (2) (or by the more detailed relationships given in other paired sets of equations) a pre-load may be obtained by stretching the band 12 elastically to move the load accepting regions 18 radially outwardly relative to the geometric center of the band 12. The hub 14 and the struts 16 are then inserted into position within the stretched band 12. When positioned the externally applied stretching force is released and the band 12 closes upon the struts 16.

The preload is desirable to insure that the rotor 10' has satisfactory structure and stiffness when assembled, and that the rotor 10' is tolerant to differential fill volumes in the sample containers processed in the rotor 10'. This tolerance is accomplished by differential compression in the struts when the rotor 10' is operating.

Similar to the band shown in FIGS. 1 through 10, in the assembled, lint at rest condition, the preloaded band 12 will slightly deviate from (i.e., lie slightly inside of) the shape defined by the equilibrium curve of Equations (1) and (2) or by the more detailed relationships given in Equations (1A) and (2A) or in Equations (1) and the set of equations (2B). Thus the band 12 will be subject to bending stress while at rest. However, when rotated to speed the band will re-assume the shape of the equilibrium curve of Equations (1) and (2) (or by the more detailed relationships given in other paired sets of equations) and, for the same reasons as developed earlier, is then loaded only in tension.

In addition to the methods heretofore described, the shape of the band 12 may be verified while running to correspond to that defined by the equilibrium curves of Equations (1) and (2),or by the more detailed relationships given in the other paired sets of equations by use of the photographic technique discussed earlier.

In fact, for the rotor set forth in accordance with the paired set of equations (1B), (2B), and (1BB), (2B), because of the presence therein of the Load Ratio term (as a ration of tensile stresses), the brittle lacquer test, the use of the strain gauges, or the photographic technique, all as previously discussed, must be used. (This is not to imply that those skilled in the art may utilize other techniques to determine the load ratio or to verify the shape of the band.)

—o—O—o—

Figure 13:
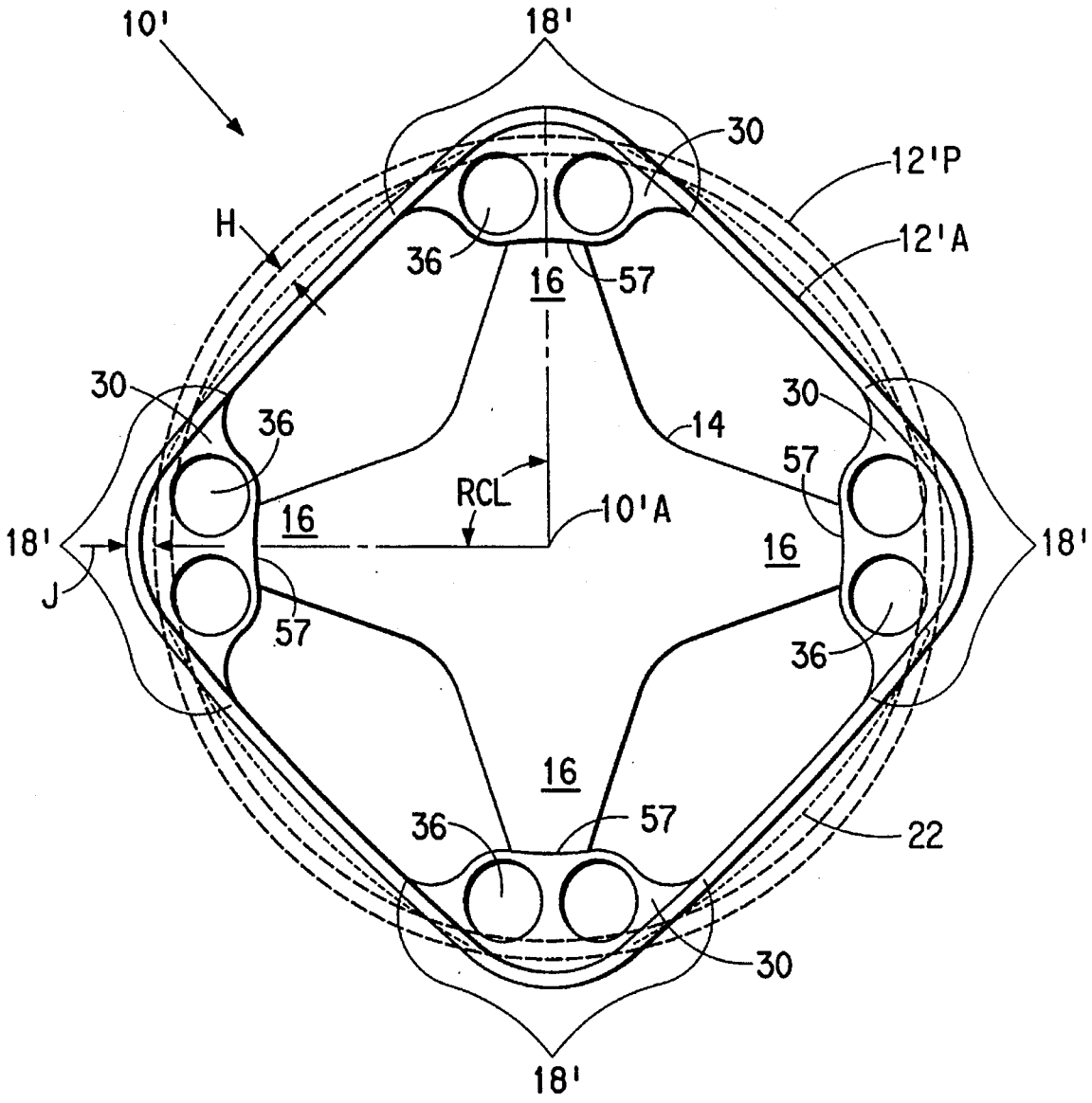
FIG. 13 is a plan view of a centrifuge rotor in which the sample carriers of the vertical type are disposed at the load accepting regions of an alternate form of applied load accepting band and in which mounting struts are disposed at load accepting regions, with the preassembled shape of the band being shown in dashed lines, the mounted shape of the band being shown in solid lines, and the equilibrium shape of a band shown by dotted lines.

In practice, depending on the stiffness of the band and the top rated speed of the rotor, it may be impractical to stretch a band 12 that satisfies the relationship defined in any of the paired sets of equations sufficiently to obtain the desired pre-load. In this instance an alternative approach is to use a band 12' which when removed from the struts has a shape that deviates from the equilibrium curves that are defined by any of the paired sets of equations FIG. 13 illustrates a rotor 10' having struts 16 which align with the load accepting regions and that uses such an alternative band 12'. Prior to assembly onto the struts 16 the band 12' is shown in dash lines 12'P, while the shape of the band 12' when mounted on the struts 16 and with the rotor 10' at rest shown in solid lines 12'A. For purposes of illustration the equilibrium curve 22 of Equations (1) and (2) is superimposed in FIG. 13 by dotted lines.

Measured along the neutral axis of the preassembly band 12'P (or the centroidal axis of the cross sectional area of the band) between the radial centerlines RCL of the load accepting regions the pre-assembly band 12'P extends for a predetermined distance $L_{actual}$. When the band 12' is assembled on the rotor 10' the length $L_{actual}$ of the pre-assembly band 12'P is equal to the length $L_{assembled}$ of the band 12'A. The distance $L_{assembled}$ is substantially equal to a predetermined distance $L_{equilibrium}$ defined between the radial centerlines of the load accepting regions of a band that follows the equilibrium curve of Equations (1) and (2) between the load accepting regions. By "substantially equal" it is meant that the distance $L_{assembled}$ lies within 1.5% to 2% of the distance $L_{equilibrium}$.

The shape of the pre-assembly band 12'P must deviate from the shape defined by the equilibrium Equations (1) and (2) in order for the band 12' to provide the desired compressive pre-load after assembly. Between the, load accepting regions 18' the pre-assembly band 12'P bows radially outwardly from the shape of the equilibrium curve 22. The maximum radial deviation occurs midway between the load accepting regions 18' and is indicated by the reference character H on FIG. 13. In the load accepting regions 18' the contour of the band 12'P bows radially inwardly a corresponding distance J sufficient to maintain the equality of distances $L_{actual}$ and $L_{assembled}$.

Upon assembly, the load accepting regions 18' of the band 12'A are held radially outwardly the distance J by the struts 16. The shape of the band 12'A on the assembled rotor between the load accepting regions 18' changes to lie inside of and approximate the equilibrium curve 22. The distance J, and thus the corresponding distance H, is determined by the amount of pre-load necessary to insure that the rotor 10' has satisfactory structure and stiffness when assembled, and that the rotor 10' is tolerant to differential fill volumes in the sample containers processed in the rotor 10'.

The amount of preload that is exerted on the struts 16 by the band 12' is a function of the distance J that the load accepting regions 18' of the band 12'A lie radially outward of the corresponding load accepting regions 18' of the preassembly band 12'P. It should be noted that the magnitude of the preload can be significantly less than the magnitude of the tension in the band during operation, and need only be as high as is required to accomplish the functions described. Regardless of the preload selected, the band will tend to take the shape of the design equilibrium curve of any of the paired sets of equations when operating and the compression force in the struts will approach the predetermined value which is zero in the preferred case.

This degree of control of the strut compression when the rotor is operating is only possible with a tension band rotor where the band closely approximates a design equilibrium shape defined by of any of the paired sets of equations when operating. Since the band will always approach a known shape the radial location of the sample carriers 30 or pads 32 at design speed is defined independently of the preload. The equilibrium curve the rotor is designed to meet is therefore selected such that the radial location of the sample carrier or pad is matched to the predicted radial location of the end of the strut 16 such that the compressive loading and the strut and the sample carrier or the pad is approaching zero at speed. The predicted radial location of the end of the strut 16 is determined from the initial length of the strut plus the increase in length due to its own body forces under centrifugation.

The above-described change in the shape of the band 12' from its preassembled shape 12'P to its assembled (but at rest) shape 12'A introduces some bending stress into the band 12'. During operation the shape of the band further changes to approach and (when at design speed) closely approximate the equilibrium shape as defined by Equations (1) and (2).

To verify that the rotor at operating speed closely approximates the design equilibrium Shape as defined by of any of the paired sets of equations, the photographic technique described above may be used.

Because the shape of the band in operation is different than the shape of the pre-assembly band 12'P the band is loaded by a predetermined total stress that is due both to bending and to pure tension. The stress due to pure tension is at least 90%, and more preferably, 95%, of the total stress in the band.

—o—O—o—

However the band is configured to provide the preload, the interfaces 57 between the struts 16 and the sample carriers 30 or the transition pads 32 must support the compressive pre-load from the band 12 or 12'. Additionally the interfaces 57 must be able to transmit torque from the hub 14 to the sample carriers 30 or the transition pads 32 and thus to the band 12, 12'.

In FIG. 11 the interface 57 between the strut 16 and a sample carrier 30 has an arcuate shape providing a simple interface geometry that is capable of positively transmitting torque. In FIG. 14 interface 57 between the strut 16 and the sample carrier 30 takes the form of a tongue-in-groove arrangement. A projection 64 on the end of the strut 16 engages a groove 65 in the sample carrier 30 or the in order to provide positive torque transmission from the strut 56 to the sample carrier 60.

Similar arrangements may be used to transmit torque from the strut 16 to the load transition pads 32 for the case of a swinging bucket rotor. However, in the case of a swinging bucket rotor the end of each strut 16 is split to define two trunnion arms 16A, 16B. The end of each arm may be arcuately shaped to engage a respective correspondingly shaped recess 67A, 67B in the pad 32. This arrangement is illustrated in FIG. 17. Alternatively, the end of each arm 16A, 16B may be provided with a respective projection 64A, 64B. Each projection 64A, 64B engages a corresponding respective groove 65A, 65B in the pad 32.

Having the struts 16 extending radially outwardly to support the sample carriers 30 or the pads 32 in the load accepting regions 18, 18' eliminates shear and transverse stresses resulting from relative motion between the band 12, 12' and the end of the struts. This is most beneficial in the case of a significant out-of-balance condition during rotor operation. An out-of-balance condition can exist from differential fill volumes in the sample containers processed in the rotor or the absence of one or more container(s) from the complement able to be processed by the rotor 10'. Differential loading between sample carriers 30 is accommodated by differential compression loading in the struts 16. Because the struts align with the line of action of the centrifugal force acting on the sample carriers no shear or transverse load is introduced to the struts.

—o—O—o—

The sample carriers 32 used in the rotors 10' of FIGS. 11 through 13 are generally similar to those discussed in connection with FIGS. 4 through 9.

More particularly, FIGS. 11 and 13 are plan views and FIG. 12 is a vertical cross section view showing a rotor 10' having sample carriers 30 in which the axis 36A of each sample receiving cavity 36 is parallel to the axis of rotation 10'A of the rotor 10'. These Figures are similar to FIGS. 6 and 7.

Figure 16:
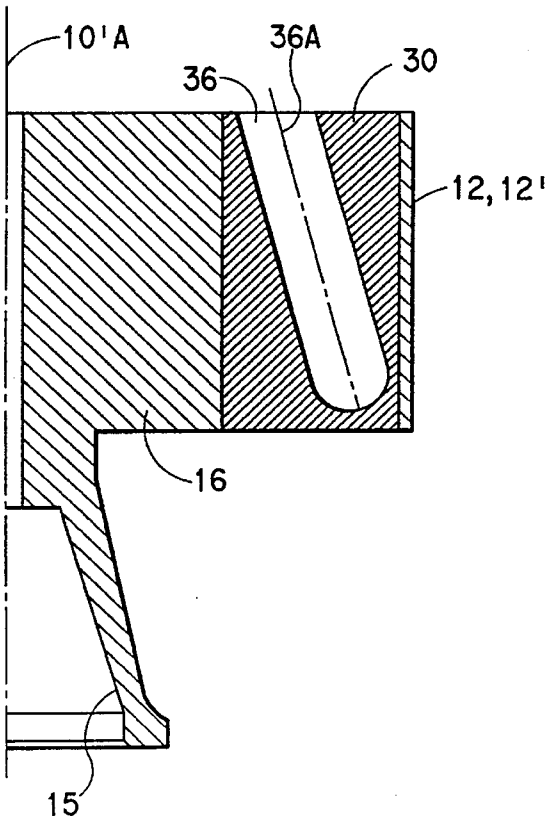
FIG. 15 and 16 are, respectively, a plan view and a side elevational view taken along section lines 16—16 in FIG. 15 illustrating a fixed angle centrifuge rotor having an applied load accepting band as shown in either FIG. 11 or in FIG. 13, the sample carriers disposed at the load accepting regions of the band being of the fixed angle type.
Figure 15:
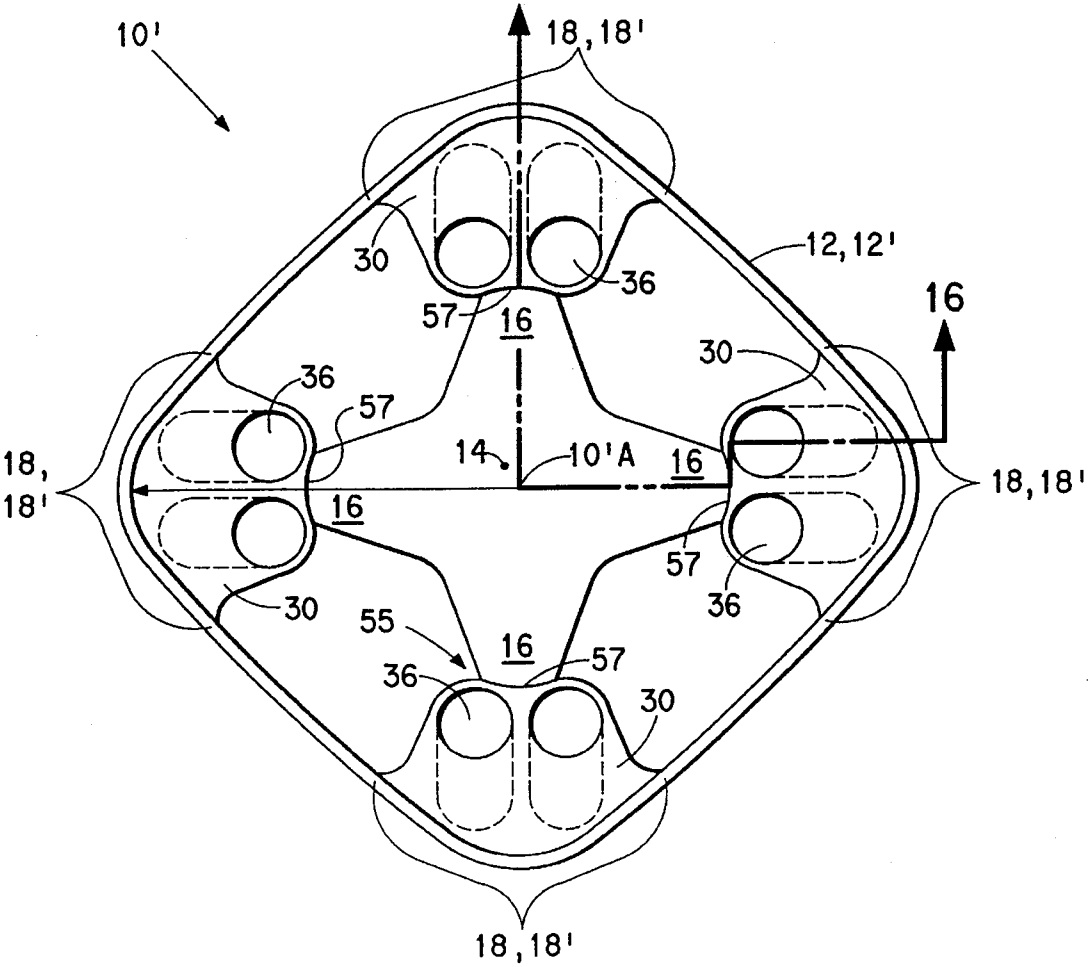
Figure 17:
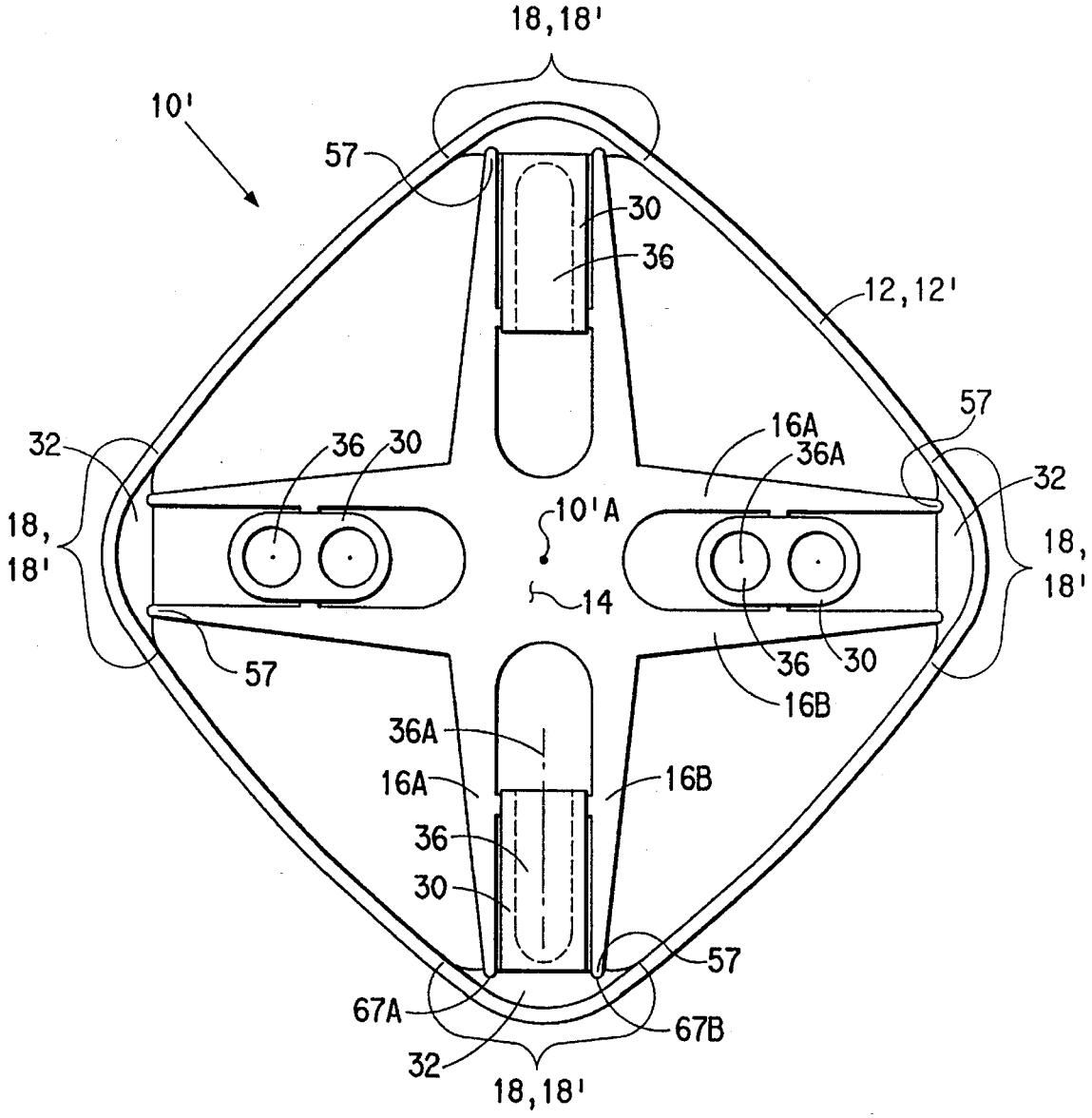
FIG. 17 is a plan view illustrating a swinging bucket centrifuge rotor having an applied load accepting band as shown in either FIG. 11 or in FIG. 13, with load transition pads being disposed at the load accepting regions of the band.

FIGS. 15 and 16 illustrate a plan and a vertical cross section view of a rotor 10' having a band 12, 12' in accordance with the present invention in which the sample carriers 30 are configured to define a fixed angle rotor. Thus, the axes 36A of the sample cavities 36 in the sample carriers 30 are inclined with respect to the axis of rotation 10'A of the rotor 10'. These Figures are similar to FIGS. 4 and 5

As yet another alternative, as seen in FIG. 17, the sample carriers 30 may be of the swinging type. To this end, the carriers 30 are thus pivotally mounted to the arms 16A, 16B of the struts 16 so that during centrifugation the axis 36A of each cavity 36 in the sample carriers 30 moves from a first, generally vertical, position to a second, generally horizontal, position. In the second position the axis 36A of the sample carrier 30 lies in a plane generally perpendicular to axis of rotation 10'A of the rotor 10. Strictly for illustrational purposes, two of the sample carriers 30 are shown in the first position and the other two carriers are shown in the second position. Moreover, means are provided whereby the end of the sample carrier 30 may move radially outwardly to its supported position against the load transition pad 32 located in the applied load accepting region 18 on the band 12.

—o—O—o—

As an alternative manufacturing technique to that earlier described, it may be convenient to properly position the sample carriers 30 or the load transition pads 32, as the case may be, in cavities within the mandrel. The outside surface of the sample carriers 30 or the pads 32 thus become part of the shape of the mandrel that defines the inside surface 12I, 12'I of the band 12, 12'. The stripe 21 of adhesive is applied to the sample carriers 30 or the pads 32. The band 12, 12' is then formed by filament winding using either tow or tape on the mandrel. Alternatively, a resin that adheres to the material of the sample carrier 30 may be used as the resin of the band 12, 12'. Prior to winding the band 12, 12' the outside surface of the carrier 30 is masked with a suitable release agent leaving only the areas desired to be bonded (the narrow stripe described before).

The struts 16 are mounted to the sample carriers 30 or the pads 32, as the case may be, by an interference fit. This is accomplished by straightening the band 12, 12' between the load accepting regions 18, 18' by simply squeezing the band 12, 12' inward midway between the load accepting regions using appropriately shaped jaws. This, in effect, moves the sample carriers 30 or the pads 32 outwardly, allowing the hub 14 and the struts 16 to be inserted. The properly preloaded, assembled band results upon removal of the jaws.

Those skilled in the art, having the benefits of the teachings of the present invention as hereinabove set forth, may effect numerous modifications thereto. However, such modifications lie within the contemplation of the present invention, as defined by the appended claims.

APPENDIX

With reference to the free body diagram of FIG. 3A, the derivation of Equations 1 and 2 for the equilibrium curve, and thereby the shape, of a band 12 may be understood. In FIG. 3A a portion of the band 12 between the midpoint 22C of the equilibrium curve 22 and a predetermined endpoint 22L-2 is shown. The reference axes for a Cartesian and a polar coordinate system are also shown. In the derivation of the most general case of the equations for the equilibrium curve the endpoint 22L-2 is located on the band 12 at the load accepting region 18-2 (FIG. 1) and the load accepting region is depicted as a point through which the applied load may act. The radii of the band at these respective points is indicated by the characters $R_0$ and $R_L$, respectively. The angular distance between any radius R and the radius $R_0$ is indicated by the angle Θ. The portion of the equilibrium curve 22 not shown in FIG. 3A between the midpoint 22C of the equilibrium curve 22 and the endpoint 22L-1 is symmetric to the portion of the equilibrium curve shown in FIG. 3A.

The free body diagram illustrates the forces acting on the band 12 while the same is spinning. In accordance with the present invention the band 12 has the same shape both while at rest and while spinning. The shape of the band is such that while the band is spinning it is subjected only to a tension force. Stated alternatively, when spinning the tension in the band balances the centrifugal force on the band due to its mass and the load on the band at the load accepting regions.

As seen in the free body diagram each end of the segment of band has a tension force imposed thereon. The forces are indicated by the characters $T_0$ and T, respectively, which designate the tension forces in the band at the midpoint 22C and the endpoint 22L-1. The magnitude of the indicated tension forces on the band inherently includes the loading on the band due to the weight of the sample and the sample carrier. The centrifugal force acting on the center of mass of the band is indicated by the character F.

Summing forces in the x direction and thereafter differentiating produces the following:

$$\Sigma F_x=0$$

$$F_x+T_x-T_0=0$$

$$F_x=T_0-T_x$$

$$dF_x=-dT_x \quad \text{(A)}$$

Similarly summing forces in the y direction and thereafter differentiating produces the following:

$$\Sigma F_y=0$$

$$F_y-T_y=0$$

$$F_y=T_y$$

$$dF_y=dT_y \quad \text{(B)}$$

Figure 3C:
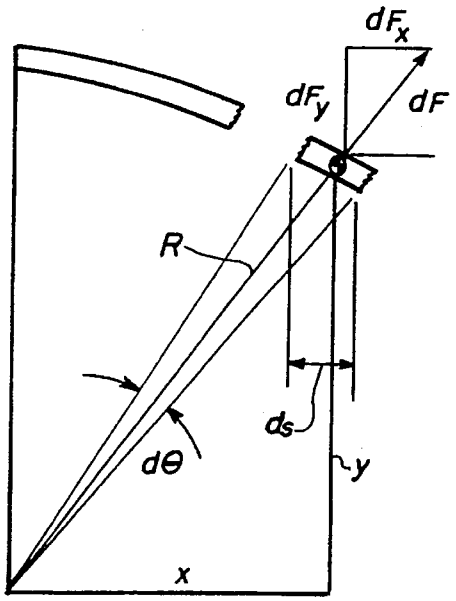

As seen from FIGS. 3B and 3C, the mass of a differential segment ds of the band is din, its cross sectional area is A, and its density is γ. If its angular speed is ω, the differential centrifugal force dF on the differential segment of the band may be expressed as $$dF=R\omega^2 dm \quad \text{(C)}$$

Substituting the expression (γA ds) (1/g) for the differential mass dm, Equation (C) becomes $$dF=(\gamma A\omega^2)\ (1/g)\ (R\ ds) \quad \text{(D)}$$

From FIG. 3C, similar triangles yield $$dF/dF_x=R/x;\ dF/dF_y=R/y$$

and $$dF_x=dF(x/R);\ dF_y=dF(y/R) \quad \text{(E)}$$

From Equations (D) and (E) the components of dF are:

$$dF_x=(\gamma A\omega^2)\ (1/g)x\ ds \quad \text{(F)}$$

$$dF_y=(\gamma A\omega^2)\ (1/g)y\ ds \quad \text{(G)}$$

From Equations (A) and (F)

$$dT_x/ds=-(\gamma A\omega^2)\ (1/g)x \quad \text{(H)}$$

and from Equations (B) and (G)

$$dT_y/ds=(\gamma A\omega^2)\ (1/g)y \quad \text{(I)}$$

From the free body diagram of FIG. 3A $$T^2=T_y^2+T_x^2$$

Differentiating and dividing by two yields $$T\ dT=T_y\ dT_y+T_x dT_x$$

$$T\ dT=T_x[(T_y/T_x)\ dT_y+dT_x] \quad \text{(J)}$$

Since the vectors ds and T both have the same direction (perpendicular to the endface of the segment of the band) similar triangles in FIG. 3A yield $$(T_y/T_x)=-(d_y/d_x);\ T_x=T(dx/ds) \quad \text{(K)}$$

Substituting Equation (K) into Equation (J)

$$T\ dt=T(dx/ds)\ [-(dy/dx)dT_y+dT_x] \quad \text{(L)}$$

Simplifying Equation (L)

$$dT=-(dT_y/ds)dy+(dT_x/ds)dx \quad \text{(M)}$$

From Equations (H) and (I)

$$dT=-[(\gamma A\omega^2)\ (1/g)y]dy+[(\gamma A\omega^2)\ (1/g)x\ ]dx \quad \text{(N)}$$

and $$dT=-(\gamma A\omega^2)\ (1/g)\ (y\ dy+x\ dx) \quad \text{(O)}$$

Assuming a constant cross-section for the band, integrating Equation (O) over the limits $T_0$ to T yields Noting from FIG. 3C that $(y^2+x^2)=R^2$, Equation (P) becomes $$T-T_0=-(\gamma A\omega^2)\ (1/2g)\ (R^2-R_0^2) \quad \text{Q}$$

and factoring $R_0^2$ from Equation (Q) and rearranging yields $$T=T_0-[(\gamma A\omega^2)\ (1/2g)]R_0^2\ [(R/R_0)^2-1] \quad \text{(R)}$$

Dividing Equation (R) by $T_0$, remembering that a constant cross section band is assumed, and noting that the stress is tension per unit area (that is, $\sigma_0=T_0/A_0$), Equation (R) becomes $$T/T_0=1-[(\gamma\omega^2R_0^2)\ (1/\sigma_0)][(R/R_0)^2-1] \quad (S)$$

and $$T/T_0=1-\{K/2[(R/R_0)^2-1]\} \quad (T)$$

where $$K=[(\gamma\omega^2R_0^2)\ (1/g)\ (1/\sigma_0)] \quad (2)$$

Recalling the assumption that the load acts through a point in the load accepting region, and that the thickness t (FIGS. 3A, 3B) of the band is neglected, summing moments about the origin of the free body diagram of FIG. 3A yields $$T_0R_0=T_\Theta R$$

$$T_\Theta/T_0=R_0/R \quad (U)$$

In FIG. 3A, the force triangle of the vector T yields, $$T_R^2+T_\Theta^2=T^2$$

Rearranging and dividing by $T_0^2$ $$(T_R/T_0)^2=(T/T_0)^2-(T_\Theta/T_0)^2 \quad (V)$$

Inserting Equations (U) and (T) into Equation (V) yields $$(T_R/T_0)^2=(1-\{K/2\ [(R/R_0)^2-1]\})^2-(R_0/R)^2$$

and $$(T_R/T_0)=RAD(1-\{K/2\ [(R/R_0)^2-1]\})^2-(R_0/R)^2 \quad (W)$$

Multiplying the right hand side of Equation (W) by $R/R_0$ and the left hand side by $(T_0/T_\Theta)$ (which from Equation (U) is equal to $R/R_0$) yields $$(T_R/T_\Theta)=(R/R_0)RAD\ (1-\{K/2[(R/R_0)^2-1]\})^2-(R_0/R)^2 \quad (X)$$

Since the vector R dΘ and the vector dR respectively extend in the same direction as the vectors $T_\Theta$ and $T_R$, respectively, similar triangles yields $$T_R/T_\Theta=dR/R\ d\Theta \quad (Y)$$

Multiplying the numerator and the denominator of Equation (Y) by $(1/R_0)$ yields $$T_R/T_\Theta=d(R/R_0)/[(R/R_0)d\Theta]$$

which simplifies to $$(R/R_0)\ (T_R/T_\Theta)=d(R/R_0)/d\Theta \quad (Z)$$

Therefore, for a band that exhibits a constant area, inserting Equation (X) into Equation (Z)

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)],\ 0<K<1 \quad (2)$$

The constant K defines a shape factor K for each of the family of equations that satisfy the differential equation (1). Since the band is to be exposed only to a tensile force while spinning the shape factor K must limited to within the range 0<K<1. If K lies outside these limits an equilibrium condition is not possible. The physical explanation of the limits on K can be understood with reference to a consideration of the ranges of loads able to be accommodated by a band in accordance with the invention.

As seen in the drawing FIG. 3D the differential Equations (1) define a family of equilibrium curves. If the shape factor K=1, the equilibrium curve takes the form of a circle. However, a circular form for the equilibrium curve would mean that no component of band tension is available contribute to supporting a load applied to the band. A band subjected only to a tensile force while spinning would thus be able to accommodate zero load without bending—an impractical result. Thus to support a load, a circular band must necessarily be subjected bending.

If the shape factor K=0, the equilibrium curve takes the form of a straight line. In this instance there is no component of band tension able to contribute to supporting the centrifugal force exerted on the mass of the band. Thus, a band having an equilibrium curve in the form of a straight line and being subjected only to a tensile force while spinning must have zero mass, a clearly absurd result.

Thus, a band in accordance with the present invention which is subjected only to tensile force while spinning must, of necessity, have a shape factor K that lies within the range 0<K<1.

—o—O—o—

As noted, the above analysis represents the derivation of the most general form of the equilibrium curve, and, thus, the shape of the curve between load accepting regions. In generating the most general form of the equilibrium curve for between the load regions, the load accepting regions are treated as a point, and, the thickness t of the band is neglected. However, as a first refeinement to the analysis, it is recognized that the thickness of the band imparts a stress that must be considered.

Body forces acting on the band result in essentially equal radial displacement of the inside and outsides surfaces. However, since the inner surface has a smaller circumferential length, its tangential strain (and therefore stress) will be greater than that of the outer surface. In an actual band of finite thickness, there would be a tangential strain differential between the inside and outside surfaces. In the case of an optimally shaped band, these strain differences need to be minimized. The following analysis defines a moment that can be incorporated in generating the equilibrium curves of the span between the loads and the load accepting regions. The following analysis makes reference to FIGS. 3A and 3B. From these Figures $$S=(\Theta)\ (R)$$

Differentiating, this equation becomes $$dS=(\theta)\ (dR)$$

By definition the modulus of elasticity is $$E=\sigma/(dR/R) \quad \text{(AA)}$$

Rearranging $$(E)\ (dR)=(\sigma)\ (R)=Constant \quad \text{(BB)}$$

Since Equation (BB) results in a constant, the product of the stress ($\sigma$) at any given radius (R) can be equated to the product of the stress at any other given radius. Thus, for a radial position at the inside surface of the band and at an average radial position in the band $$(\sigma_{in})\ (R_{in})=(\sigma_{avg})\ (R_{avg}) \quad \text{(CC)}$$

Recognizing from FIG. 3B that for a band of thickness t (indicated in FIG. 1 by the reference character 12T)

$$(R_{in})=(R_{avg}-t/2) \quad \text{(DD)}$$

Equation (CC) becomes $$[R_{avg}-(t/2)](\sigma_{in})=(\sigma_{avg})\ (R_{avg}) \quad \text{(EE)}$$

Rearranging $$\sigma_{in}=[(2R)/(2R-t)](\sigma_{avg}) \quad \text{(FF)}$$

By definition, the stress at any point through the thickness of the band would be the stress due to tensile forces ($\sigma_{avg}$) plus any additional stresses due to bending. Thus, $$\sigma_{in}=\sigma_{avg}+\sigma_{bend} \quad \text{(GG)}$$

$$\sigma_{bend}=\sigma_{in}-\sigma_{avg} \quad \text{(HH)}$$

Substituting $\sigma_{in}$ from Equation (FF) and factoring $$\sigma_{bend}=(\sigma_{avg})\{[2R/(2R-t)]-1\} \quad \text{(II)}$$

Stress may be defined in terms of force per unit area, thus, $$\sigma_{avg}=T/(H\ xt) \quad \text{(JJ)}$$

where
H is the height of the band and
t is its thickness.

From Equations (II) and (JJ)

$$\sigma_{bend}=T/[Hx(2R-t)] \quad \text{(KK)}$$

Bending stress may also be defined in terms of bending moment, thus $$\sigma_{bend}=MC/I \quad \text{(LL)}$$

where
M is the Compensating Moment
C is the distance from the centroid and
I is the moment of inertia of the band.

By substituting (LL) into (KK) and solving for the Compensating Moment M, $$M=(T/6)x[t^2/(2R-t)] \quad \text{(MM)}$$

The derivation of the equilibrium curve for the band between the load regions, taking into account the Compensating Moment proceeds in the same manner as that in the most general case up to Equation (T) . However, when moments are summed about the origin the Compensating Moment M given by Equation (MM) is also taken into account. Thus, summing Moments about the origin $$R_0T_0+M_0=T_\theta R+M \quad \text{(NN)}$$

From Equation (MM)

$$M=(T/6)x\ [t^2/(2R-t)]M_0=(T/6)x\ [t^2/(2R_0-t)]$$

Solving equation (NN) for $T_\theta$ yields $$T_\theta=(1/R)\ (R_0T_0+M_0-M) \quad \text{(OO)}$$

$$T_\theta=(R_0/R)T_0+(T_0/6)\ [(t^2/(2R_0-t)]-(T/6)\ [t^2/(2R-t)] \quad \text{(PP)}$$

Re-arranging Equation (T)

$$T=T_0-(K/2)\ (T_0)\ ((R/R_0)^2-1) \quad \text{(QQ)}$$

where $$K=[(\gamma\omega^2R_0^2)\ (1/g)\ (1/\sigma_0)],\ 0<K<1 \quad (2)$$

Using similar triangles from FIG. 3A

$$T_\theta/T_u=U(d\theta/du)$$

which, after multiplying the numerator and denominator of the right side of the equation by ($1/R_0$) and rearranging, yields $$d(R/R_0)/d\theta=(R/R_0)\ (T_R/T_0) \quad \text{(RR)}$$

To solve for the equilibrium equation, $T_R/T_\theta$ must be found.

Referring to FIG. 3A, it can be shown from the force triangle that, $$T_R^2=T^2-T_\theta^2$$

$$\frac{T_R}{T_\theta}=\sqrt{\left(\frac{T}{T_0}\right)^2-1} \quad \text{(SS)}$$

Substituting Equations (PP) and (QQ) into Equation (SS) and simplifying terms $$\frac{T_R}{T_\theta}=\sqrt{\left[\frac{1-\frac{K}{2}\left[\left(\frac{R}{R_0}\right)^2-1\right]}{\frac{R_0}{R}+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1} \quad \text{(TT)}$$

where $$K=[(\gamma\omega^2R_0^2)\ (1/g)\ (\ 1/\sigma_0)],\ 0<K<1 \quad (2)$$

Substituting Equation (TT) into Equation (RR) yields $$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad \text{(1A)}$$

where $$K=[(\gamma\omega^2R_0^2)\ (1/g)\ (\ 1/\sigma_0)],\ 0<K<1 \quad (2)$$

Equation (1A) defines the equilibrium curve of the band between the load regions modified to accommodate the thickness of the band taking into account the Compensating Moment. It should be noted that as the thickness t approaches zero, the compensating moment will also approach zero, and Equation (1A) then reverts to the form of Equation (1) (in which the thickness t is neglected).

—o—O—o—

To further optimize the band, it is necessary to derive an equilibrium equation for the load accepting region 18 (FIG. 1) that takes into account the Compensating Moment.

Summing forces in the X and Y directions and thereafter differentiating produces equations (A) and (B) as described before.

As seen from FIGS. 3A and 3B, if the mass of a differential segment dS of the band is din, its density is y, its angular speed is ω and the applied load is $\sigma_c$, then the differential centrifugal force dF on the differential segment of the band may be expressed as $$dF=R\omega^2dm+\sigma_cH\ dS \quad \text{(UU)}$$

Substituting the expression (γA ds) (1/g) (where A is the cross-sectional area of the band) for the differential mass din, Equation (UU) becomes $$dF=(\gamma A\omega^2)\ (1/g)\ (RdS)+(\sigma_cHDs) \quad \text{(VV)}$$

From FIG. 3A, similar triangles yields $$dF_x=(x/R)\ (dF);\ dF_y=(y/R)\ (dF) \quad \text{(WW)}$$

From Equations (VV) and (WW) the components of dF are:

$$dF_x=[(\gamma A\omega^2)\ (1/g)\ (x)+(\sigma_cH)\ (1/R)\ (x)]dS \quad \text{(XX)}$$

$$dF_y=[(\gamma A\omega^2)\ (1/g)\ (y)+(\sigma_cH)\ (1/R)\ (y)]dS \quad \text{(YY)}$$

From Equations (A) and (XX)

$$dT_x/dS=(-1)\ [(\gamma A\omega^2)\ (1/g)\ (x)+(\sigma_cH)\ (1/R)\ (x)] \quad \text{(ZZ)}$$

and from Equations (B) and (YY)

$$dT_y/dS=(-1)\ [(\gamma A\omega^2)\ (1/g)\ (y)+(\sigma_cH)\ (1/R)\ (y)] \quad \text{(AAA)}$$

From free body diagram of FIG. 3A $$T^2=T_y^2+T_x^2$$

Differentiating and dividing, by two yields $$TdT=T_ydT_y+T_xdT_x$$

$$TdT=T_x[(T_y/T_x)dT_y+dT_x \quad \text{(BBB)}$$

Since the vectors dS and T both have the same direction (perpendicular to the end face of the segment of the band) similar triangles in FIG. 3A yield $$(T_y/T_x)=-(dy/dx);\ T_x=T(dx/ds) \quad \text{(CCC)}$$

Substituting Equation (CCC) into (BBB)

$$TdT=T(dx/ds)\ [dT_x-(dy/dx)dT_y] \quad \text{(DDD)}$$

From Equations (ZZ) and $$dT=[(\gamma A\omega^2)\ (1/g)\ (x)+(\sigma_cH)\ (1/R)\ (x)]dx-[(\gamma A\omega^2(1/g)\ (y)+(\sigma_cH)\ (1/R)\ (y)]dy \quad \text{(EEE)}$$

and $$dT=-(\gamma A\omega^2)\ (1/g)\ (xdx+ydy)-(\sigma_cH)\ (xdx+ydy)\ (1/R) \quad \text{(FFF)}$$

As FIG. 3A shows by definition $$R^2=x^2+y^2$$

which when differentiated becomes $$RdR=xdx+ydy \quad \text{(GGG)}$$

Substituting Equation (GGG) into Equation (FFF)

$$dT=-(\gamma A\omega^2)\ (1/g)\ (RdR)-(\sigma_c HdR) \quad \text{(HHH)}$$

Assuming a constant cross-section for the band, integrating Equation (HHH) over the limits T and $T_L$ yields $$T_L-T=(\gamma A\omega^2)\ (1/2g)\ (R^2-R_L^2)+(\sigma_c H)\ (R-R_L) \quad \text{(III)}$$

Rearranging $$T=T_L-(\gamma A\omega^2)\ (1/2g)\ (R^2-R_L^2)+(\sigma_c H)\ (R-R_L)$$

Factoring $R_L^2$, $R_L$ and simplifying $$T=(LR)T_0-T_0(K_1/2)\ ((R/R_L)^2-1)+T_0(K_2)\ ((R/R_L)-1) \quad \text{(JJJ)}$$

where $$LR=T_L/T_0=\textit{Load Ratio}$$

$$K_1=[(\gamma A\omega^2)\ (1/g)\ (1/T_0)\ (R_L^2)]=[(\gamma\omega^2 R_L^2)\ (1/g)\ (1/\sigma_0)]$$

$$K_2=[(R_L\sigma_c H)/T_0]$$

Using a method similar to that used in deriving the most general form of the equilibrium equation between the loads, moments will be summed about the origin, taking into account the Compensating Moment.

From the free body diagram of FIG. 3A summing moments about the origin:

$$\Sigma M=0$$

$$R_L T_L+M_L=T_{7A}\ R+M \quad \text{(KKK)}$$

where $$M=[(T/6)\ (t^2/(2R-t))]$$

$$M_L=[(T_L 6)\ (t^2/(2R_L-t))]$$

with M representing the Compensating Moment at any radius R and $M_L$ representing the Compensating Moment at the radius $R_L$.

Rearranging and substituting in M and $M_L$ $$T_\theta=T_L(R_L/R)+T_L(1/6)\ [t^2/(2R_L-t)]-T(1/6)\ [t^2/(2R-t)] \quad \text{(LLL)}$$

Substituting Equation (III) into Equation (KKK) and simplifying $$T_\theta=T_0(R_L/R)+(1/R)\{T_0/6)\ [t^2/(2R_L-5)]-T/6)\ [\ t^2/(2R-t)]\} \quad \text{(MMM)}$$

Using similar triangles from FIG. 3A $$T_\theta/T_R=R(d\theta/dR)$$

Multiplying the numerator and denominator of the right side of the equation by $(1/R_L)$ and rearranging yields $$d(R/R_L)/d\theta=(R/R_L)\ (T_L/T_\theta) \quad \text{(NNN)}$$

To solve for the equilibrium equation, $T_R/T_\theta$ must be found. Referring to FIG. 3A, it can be shown from the force triangle that, $$T_R^2 = T^2 - T_\theta^2$$

$$\frac{T_R}{T_\theta}=\sqrt{\left(\frac{T}{T_\theta}\right)^2-1} \quad \text{(OOO)}$$

Dividing Equation (MMM) by $T_0$ and multiplying the left hand side by $(T_0/T)$ and the right hand side by $$\{LR)-(K_1/2)\ [(R/R_L)^2-1]+(K_2)\ [(R/R_L)-1]$$

[which from Equation (JJJ) is equal to $T/T_0$] yields:.

$$\frac{T}{T_\theta}=\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}} \quad \text{(PPP)}$$

Substituting Equation (PPP) into Equation (OOO) and subsequently (OOO) into (NNN) yields the equilibrium equation for the load accepting region:

$$\frac{d\left(\frac{R}{R_L}\right)}{d\theta} = \left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=T_L/T_0$$

$$K_1=[(\gamma\omega^2 R_L^2)\ (1/g)\ (1/\sigma_0)]$$

$$K_2=[(R_L\sigma_c H)/T_0] \quad (2B)$$

where $$Z=R_0/R_L$$

The differential Equation (1B) [paired with the set of equations indicated by the character (2B)] represents the optimized equilibrium equation for the band in each of the load accepting regions.

The methodology used in determining the equilibrium equation for the load accepting region (that is, the region of the band in the plane perpendicular to the axis, at any angular position Θ from the transition point to the reference line $R_L$) can be used to determine the equilibrium equation of the region of the band spanning the load accepting regions. The only difference being in the integration step, Equation (HHH). At that point the equation (HHH) will be integrated over the limits $T_0$ to T (for dT) and R to $R_0$ (for dR). Carrying the analysis through yields the equilibrium equation for the region of the band spanning the load accepting region between the midpoint of said region (i.e., $R_0$) and the transition point (at the radius $R_T$).

$$T=T_1 \text{ and } R=R_1 \quad (QQQ)$$

The tension equations for both the load region and the region spanning the distance between the load accepting regions are:

$$T/T_0=LR+(K_1/2)\ [1-(R/R_L)^2]+(K_2)\ [1-(R/R_L)] \quad (RRR)$$

and $$T/T_0=1-(K_1/2)\ [(R/R_L)^2-Z^2] \quad (SSS)$$

where $$Z=R_0/R_L \quad (3B)$$

Equating Equations (RRR) and (SSS), substituting into Equations (QQQ) and solving for $R_T$ yields:

$$R_T=R_L+\{[(K_1/2)\ (R_L^2)\ (1-Z^2)]/(K_2)\}-[(1-LR)/K_2] \quad (4B)$$

The Load Ratio LR also needs to be derived. This is accomplished by summing the moments about the origin. The Load Ratio will be found in terms of $R_L$, Z, and t.

$$\frac{d\left(\frac{R}{R_0}\right)}{d\theta} = \left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1} \quad (1BB)$$

The differential Equation (1BB) [paired with the set of equations indicated by the character (2B)] represents the optimized equilibrium equation for the band in the region spanning each of the load accepting regions.

—o—O—o—

Figure 3E:
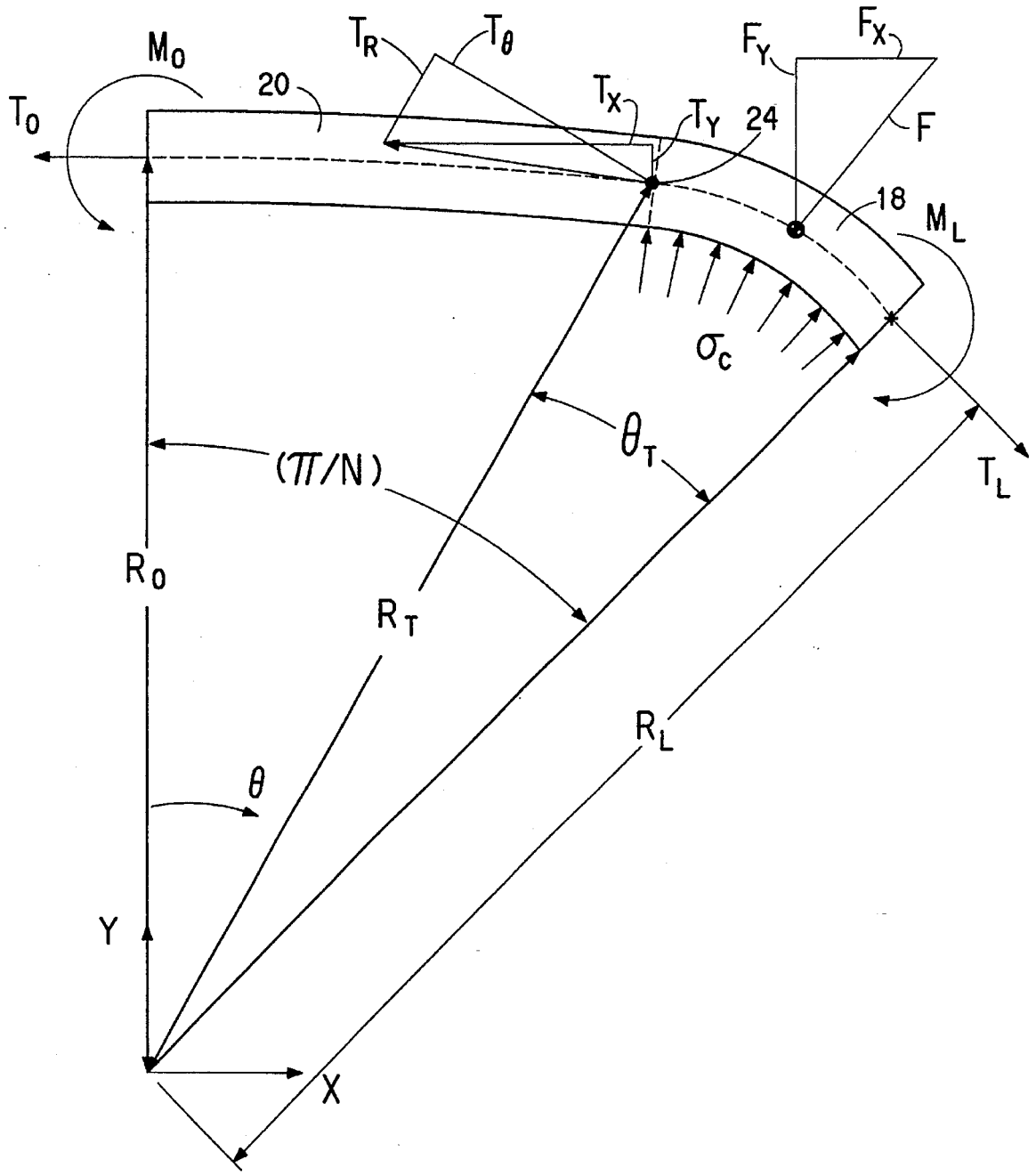
FIG. 3E is a free body diagram generally similar to FIG. 3A for a portion of a band for a centrifuge rotor including both a portion of a load accepting region and a portion of the band next adjacent thereto, in which the load accepting region has a predetermined circumferential length and the band has a predetermined thickness.

The next step in this analysis is to determine the radius $R_T$ (which occurs at the radius $R_T$ at the angular position $\theta_T$ as shown in FIG. 3E) as a function of the Load Ratio I,R. This is accomplished by equating the tension force equations at the radius $R_t$ for both the load bearing region and the span region 20 between the loads. At the radius $R_t$ $$R_L(T_L)+M_L=R_0(T_0)+M_0$$

where $$M_L=(T_L/6)\ [t^2/(2R_L-t)]$$

where $$M_)=(T_0/6)\ [t^2/(2ZR_L-t)]$$

where $Z=R_0/R_L$

Solving for the Load Ratio $LR=T_L/T_0$ $$LR=\{ZR_L+[t^2/((6(2ZR_L-t))]\}/\{R_L+[t^2/((6(2R_L-t))]\} \quad (5B)$$

Equations (1B), (1BB), (2B), (3B), (4B), (5B) are sufficient to uniquely determine the shape of the band when taking into account the thickness t, the load region and the region between the loads. These equations have seven variables, any one of which can be solved given the remaining six. For example, in a typical rotor design the following variables are usually given: $\gamma$, $\omega$, $\sigma_0$, $\sigma_c$, N, t, $R_L$.

The following steps can then be taken to find the shape of the band:

(1) From Equation (2B) solve for $K_1$, $K_2$.

(2) Assign a value to "Z".

(3) From Equation (5B) solve for LR.

(4) From Equation (4B) solve for $R_T$.

(5) Integrate Equation (1B) between the limits $R_L$ and $R_T$ (6) Integrate Equation (1BB) between the limits $R_T$ and $ZR_L$.

(7) Integrate on "Z" until the results of Steps (5) and (6) converge on a single value. This value is $\Theta_T$, the transition angle.

(8) Use the final value of "Z" to determine $R_T$ and LR.

(9) From Equation (1B) and (1BB) determine the shape of the band in the load accepting regions and in the region spanning the load accepting regions, respectively.

—o—O—o—

The equilibrium curve of any band in accordance with the present invention (that is, a band subjected only to tension while spinning) will exhibit an equilibrium curve between a midpoint of a band segment and the endpoint thereof (as these points are defined herein) that closely matches one of the family of equilibrium curves defined by Equations (1).

To determine that the equilibrium curve of a band as the same is used in an actual rotor the band is first removed from the struts that affix it to the hub. The contour of the actual band may then be plotted. The equilibrium curve extends through the center of the band. In an actual rotor, the angle $\Theta$ (in degrees) that the radius from the axis of rotation through the load point (the radius $R_L$), will be known from the relationship $$\Theta=360/(2N)$$

where N is the number of places on the rotor. Thus, one endpoint of the equilibrium curve of the actual rotor is the point on the band just adjacent to the load accepting region of the actual rotor. The midpoint of the band (the radius $R_O$), is typically (but not necessarily) the point at which the strut attaches to the band. If the band is exposed only to tension when spinning, the equilibrium curve of the band will closely match one of the family of equilibrium curves shown in FIG. 3D (in the most general case). That is, the equilibrium curve of the band from the actual rotor will fall on one of the family of curves in the range between $R_0$ and $R_L$ or will lie within a predetermined range of one of the family of equilibrium curves.

To verify that such a band is subjected to only a tensile force, a brittle lacquer test may be performed (preferably prior to the disassembly of the rotor from the struts, as discussed above). The brittle lacquer test is discussed in Richard C. Dove and Paul H. Adams, "Experimental Stress Analysis and Motion Measurement", Charles E. Merrill Books, Inc., Columbus, Ohio (1964). Other tests (e.g., using strain gauges or photographic techniques) to verify that the band is subjected only to tensile forces could be performed. Such testing could include the mounting of strain gauges on inside and outside radial surfaces of the band. The brittle lacquer test as well as the other test can be use to determine tensile forces on any point of the band. Accordingly, such tests may be used to determine the Load Ratio (LR) used in Equation (2B).

What is claimed is:

1. A continuous band adaptable for use as an applied load accepting band in a centrifuge rotor, the band having a central rotational axis extending therethrough and at least a first and a second applied load accepting region defined thereon, characterized in that the band has an equilibrium curve defined between the applied load accepting regions, the equilibrium curve having a midpoint therealong, the distance in the plane perpendicular to the axis between the axis and the midpoint being defined by a predetermined reference line $R_0$, such that, in the,plane perpendicular to the axis, at any angular position (i) from the reference line $R_0$, each point on the equilibrium curve between the midpoint thereof and a point adjacent to one of the applied load accepting regions lies a predetermined distance R from the axis, the distance R at the corresponding angular position (i) being defined by the relationship:

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

$\omega$ is the angular speed, $\gamma$ is the density of the band, g is the acceleration due to gravity, and $\sigma_0$ is the stress per unit area in the band, and where $0<K<1$, the cross sectional area of the band being constant at each point therealong intermediate the applied load accepting regions such that, when the band is rotated, it is loaded only by a tensile stress.

2. A centrifuge rotor comprising:

a hub having at least a first and a second strut;

a continuous band adaptable for use as an applied load accepting band mounted to the struts, the band having a central rotational axis extending therethrough and at least a first and a second applied load accepting region defined thereon, characterized in that the band, when it is removed from the struts by which it is attached to the hub and while the band is at rest, has an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position $\Theta$ from the reference line $R_0$, each point on the equilibrium curve between the midpoint thereof and a point adjacent to one of the applied load accepting regions lies a predetermined distance R from the axis, the distance R at the corresponding angular position Θ being defined by the relationship:

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

ω is the angular speed,

γ is the density of the band, g is the acceleration due to gravity, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

3. A continuous band adaptable for use as an applied load accepting band in a centrifuge rotor, the band having a central rotational axis extending therethrough and at least a first and a second applied load accepting region defined thereon, characterized in that the band has an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$, each point on the equilibrium curve between the midpoint thereof and a point adjacent to one of the applied load accepting regions lies a predetermined distance $R_{actual}$ from the axis, each distance $R_{actual}$ approximating a reference distance R, where the reference distance R at the corresponding angular position Θ is defined by the relationship:

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

ω is the angular speed,

γ is the density of the band, g is the acceleration due to gravity, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

4. A centrifuge rotor comprising:

a hub having at least a first and a second strut; and a continuous band adaptable for use as an applied load accepting band mounted to the struts, the band having a central rotational axis extending therethrough and at least a first and a second applied load accepting region defined thereon, characterized in that the band, when it is removed from the struts by which it is attached to the hub and while the band is at rest, has an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$ each point on the equilibrium curve between the midpoint thereof and a point adjacent to one of the applied load accepting regions lies a predetermined distance $R_{actual}$ from the axis, each distance $R_{actual}$ approximating a reference distance R, where the reference distance R at the corresponding angular position Θ is defined by the relationship:

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

ω is the angular speed,

γ is the density of the band, g is the acceleration due to gravity, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

5. A continuous band adaptable for use as an applied load accepting band in a centrifuge rotor, the rotor having at least a first and a second mounting strut thereon, the band having a central rotational axis extending therethrough and a first and a second applied load accepting region defined thereon, characterized in that the band, when removed from the struts, extends for a predetermined distance $L_{actual}$ measured along the band between the centers of the load accepting regions, the band, when mounted to the struts, extends for a predetermined distance $L_{assembled}$ measured along the band between the centers of the load accepting regions, the shape of the band when mounted on the struts between the load accepting regions thereon approximates the shape of an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$, each point on the equilibrium curve between the midpoint thereof and a point adjacent to one of the applied load accepting regions lies a predetermined distance R from the axis, each distance R at the corresponding angular position Θ is defined by the relationship:

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

$\omega$ is the angular speed, $\gamma$ is the density of the band, g is the acceleration due to gravity, and $\sigma_0$ is the stress per unit area in the band, and where 0<K<1, the cross sectional area of the band being constant at each point therealong intermediate the applied load accepting regions such that, when the band is rotated, it is loaded only by a tensile stress, the distance $L_{assembled}$ being substantially equal to a predetermined distance $L_{equilibrium}$ defined along the equilibrium curve between the radial centerlines of the load accepting regions of the band.

6. A centrifuge rotor comprising:

a hub having at 11east a first and a second strut; and a continuous band adaptable for use as an applied load accepting band in a centrifuge rotor, the band having a central rotational axis extending therethrough and at least a first and a second applied load accepting region define thereon, characterized in that the band, when removed from the struts, extends for a predetermined distance $L_{actual}$ measured along the band between the centers of the load accepting regions, the band, when mounted to the struts at the load accepting regions, extends for a predetermined distance $L_{assembled}$ measured along the band between the centers of the load accepting regions, the shape of the band when mounted on the struts approximates the shape of an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position $\Theta$ from the reference line $R_0$, each point on the equilibrium curve between the midpoint thereof and a point adjacent to one of the applied load accepting regions lies a predetermined distance R from the axis, each distance R at the corresponding angular position $\Theta$ is defined by the relationship:

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

$\omega$ is the angular speed, $\gamma$ is the density of the band, g is the acceleration due to gravity, and $\sigma_0$ is the stress per unit area in the band, and where 0<K<1, the cross sectional area of the band being constant at each point therealong intermediate the applied load accepting regions such that, when the band is rotated, it is loaded only by a tensile stress, the distance $L_{assembled}$ being substantially equal to a predetermined distance $L_{equilibrium}$ defined along the equilibrium curve between the radial centerlines of the load accepting regions of the band.

7. A continuous band adaptable for use as an applied load accepting band in a centrifuge rotor, the band having a central rotational axis extending therethrough and at least a first and a second applied load accepting region defined thereon, the band having a predetermined thickness t, characterized in that the band has an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position $\Theta$ from the reference line $R_0$, each point on the equilibrium curve between the midpoint thereof and a point adjacent to one of the applied load accepting regions lies a predetermined distance R from the axis, the distance R at the corresponding angular position $\Theta$ being defined by the relationship:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

$\omega$ is the angular speed, $\gamma$ is the density of the band, g is the acceleration due to gravity, t is the thickness of the band, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

8. A continuous band adaptable for use as an applied load accepting band in a centrifuge rotor, the band having a central rotational axis extending therethrough and at least a first and a second applied load accepting region defined thereon, the band having a predetermined thickness t, characterized in that the band has an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$, each point on the equilibrium curve between the midpoint thereof and a point adjacent to one of the applied load accepting regions lies a predetermined distance $R_{actual}$ from the axis, each distance $R_{actual}$ approximating a reference distance R, where the reference distance R at the corresponding angular position Θ is defined by the relationship:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

$$d(R/R_0)/d\Theta=(R/R_0)^2RAD(1-\{K/2[(R/R_0)^2-1]\})^2-(R/R_0)^2 \quad (1)$$

where $$K=[(\gamma\omega^2R_0^2)\ (1/g)\ (1/\sigma_0)] \quad (2)$$

ω is the angular speed,

γ is the density of the band, g is the acceleration due to gravity, t is the thickness of the band, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

9. A centrifuge rotor comprising:

a hub having at least a first and a second strut;

a continuous band adaptable for use as an applied load accepting band mounted to the struts, the band having a central rotational axis extending therethrough and at least a first and a second applied load accepting region defined thereon, the band having a predetermined thickness t, characterized in that the band, when it is removed from the struts by which it is attached to the hub and while the band is at rest, has an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$, each point on the equilibrium curve between the midpoint thereof and a point adjacent to one of the applied load accepting regions lies a predetermined distance R from the axis, the distance R at the corresponding angular position Θ being defined by the relationship:

where $$K=[(\gamma\omega^2R_0^2)\ (1/g)\ (1/\sigma_0)] \quad (2)$$

ω is the angular speed,

γ is the density of the band, g is the acceleration due to gravity, t is the thickness of the band, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

10. A centrifuge rotor comprising:

a hub having at least a first and a second strut; and a continuous band adaptable for use as an applied load accepting band mounted to the struts, the band having a central rotational axis extending therethrough and at least a first and a second applied load accepting region defined thereon, the band having a predetermined thickness t, characterized in that the band, when it is removed from the struts by which it is attached to the hub and while the band is at rest, has an equilibrium curve defined between the applied load accepting regions, the equilibrium curve having a midpoint therealong, the distance in the plane perpendicular to the axis between the axis and the midpoint being defined by a predetermined refer, race line $R_0$, such that, in the plane perpendicular to the axis, at any angular position Θ from the reference line $R_0$, each point on the equilibrium curve between the midpoint thereof and a point adjacent to one of the applied load accepting regions lies a predetermined distance $R_{actual}$ from the axis, each distance $R_{actual}$ approximating a reference distance R, where the reference distance R at the corresponding angular position Θ is defined by the relationship:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}+\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

where $$K=[(\gamma\omega^2R_0^2)\ (1/g)\ (1/\sigma_0)] \quad (2)$$

ω is the angular speed,

γ is the density of the band, g is the acceleration due to gravity, t is the thickness of the band, and $\sigma_0$ is the stress per unit area in the band, and where 0<K<1, the cross sectional area of the band being constant at each point therealong intermediate the applied load accepting regions such that, when the band is rotated, it is loaded only by a tensile stress.

11. A continuous band adaptable for use as an applied load accepting band in a centrifuge rotor, the rotor having at least a first and a second mounting strut thereon, the band having a central rotational axis extending therethrough and a first and a second applied load accepting region defined thereon, the banal having a predetermined thickness t, characterized in that the band, when removed from struts, extends for a predetermined distance $L_{actual}$ measured along the band between the centers of the load accepting regions, the band, when mounted to the struts, extends for a predetermined distance $L_{assembled}$ measured along the band between the centers of the load accepting regions, the shape of the band when mounted on the struts between the load accepting regions thereon approximates the shape of an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$, each point on the equilibrium curve between the midpoint thereof and a point adjacent to one of the applied load accepting regions lies a predetermined distance R from the axis, each distance R at the corresponding angular position Θ is defined by the relationship:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}+\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

where $$K=[(\gamma\omega^2R_0^2)\ (1/g)\ (1/\sigma_0)] \quad (2)$$

ω is the angular speed,

γ is the density of the band, g is the acceleration due to gravity, t is the thickness of the band, and $\sigma_0$ is the stress per unit area in the band, and where the cross sectional area of the band being constant at each point therealong intermediate the applied load accepting regions such that, when the band is rotated, it is loaded only by a tensile stress.

12. A centrifuge rotor comprising:

a hub having at least a first and a second strut; and a continuous band adaptable for use as an applied load accepting band in a centrifuge rotor, the band having a central rotational axis extending therethrough and at least a first and a second applied load accepting region defined thereon, the band having a predetermined thickness t, characterized in that the band, when removed from the struts, extends for a predetermined distance $L_{actual}$ measured along the band between the centers of the load accepting regions, the band, when mounted to the struts at the load accepting regions, extends for a predetermined distance $L_{assembled}$ measured along the band between the centers of the load accepting regions, the shape of the band when mounted on the struts approximates the shape of an equilibrium curve defined between the applied load accepting regions, the equilibrium curve having a midpoint therealong, the distance in the plane perpendicular to the axis between the axis and the midpoint being defined by a predetermined reference line $R_0$, such that, in the plane perpendicular to the axis, at any angular position Θ from the reference line $R_0$ each point on the equilibrium curve between the midpoint thereof and a point adjacent to one of the applied load accepting regions lies a predetermined distance R from the axis, each distance R at the corresponding angular position Θ is defined by the relationship:

$$\frac{d\left(\frac{R}{R_0}\right)}{d\theta}=\left(\frac{R}{R_0}\right)\left[\sqrt{\left[\frac{R\left\{1-\frac{K}{2}\left[\left(\frac{R}{R_0}\right)^2-1\right]\right\}}{R_0+\frac{1}{6}+\left(\frac{t^2}{2R_0-t}\right)+\frac{1}{6}\left[\frac{K}{2}\left[\left(\frac{R}{R_0}\right)^2-1\right]-1\right]\left(\frac{t^2}{2R-t}\right)}\right]^2-1}\right] \quad (1A)$$

where $$K=[(\gamma\omega^2R_0^2)\ (1/g)\ (1/\sigma_0)] \quad (2)$$

ω is the angular speed,
γ is the density of the band,
g is the acceleration due to gravity,
t is the thickness of the band, and
$\sigma_0$ is the stress per unit area in the band, and where, the cross sectional area of the band being constant at each point therealong intermediate the applied load accepting regions such that, when the band is rotated, it is loaded only by a tensile stress, the distance $L_{assembled}$ being substantially equal to a predetermined distance $L_{equilibrium}$ defined along the equilibrium between the radial centerlines of the load accepting regions of the band.

13. A continuous band adaptable for use as an applied load accepting band in a centrifuge rotor, the band having a central rotational axis extending therethrough, the band having a predetermined thickness t, the band having at least a first and a second applied load accepting region defined thereon and a region spanning the distance between the first and the second load accepting regions, a transition point being defined in the band between the end of the spanning region and each adjacent load accepting region, the region spanning the load accepting regions having a midpoint therealong, the distance in the plane perpendicular to the axis between the axis and the midpoint being defined by a predetermined reference line $R_0$, the distance in the plane perpendicular to the axis between the axis and the transition point being defined by a predetermined reference line $R_T$, the distance in the plane perpendicular to the axis between the axis and the midpoint of a load accepting region being defined by a predetermined reference line $R_L$, characterized in that the region of the band spanning the applied load accepting regions has an equilibrium curve and that each load accepting region has an equilibrium curve, such that, in the plane perpendicular to the axis, at any angular position Θ from the transition point to the reference line $R_L$, each point on the equilibrium curve of the applied load accepting region lies a predetermined distance R from the axis, the distance R at the corresponding angular position Θ being defined by the relationship:

$$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)\partial$$

$$K_2=[(R_L\sigma_cH)/T_0] \quad (2B)$$

where $Z=R_0/R_L$
ω is the angular speed,
γ is the density of the band,
g is the acceleration due to gravity,
t is the thickness of the band,
$\sigma_c$ is the applied load per unit area in the load accepting region of the band
H is the height of the band, and
$T_0$ is the tensile force in the band at the midpoint thereof the cross sectional area of the band being constant at each point therealong intermediate the applied load accepting regions such that, when the band is rotated, it is loaded only by a tensile stress.

14. The band of claim 13 characterized in that, in the plane perpendicular to the axis, at any angular position Θ from the transition point to the reference line $R_L$, each point on the equilibrium curve of the region of the band spanning the applied load accepting regions lies a predetermined distance R from the axis, the distance R at the corresponding angular position Θ being defined by the relationship:

$$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1}. \quad (1BB)$$

15. A continuous band adaptable for use as an applied load accepting band in a centrifuge rotor, the band having a central rotational axis extending therethrough, the band having a predetermined thickness t, the band having at least a first and a second applied load accepting region defined thereon and a region spanning the distance between the first and the second load accepting regions, a transition point being defined in the band between the end of the spanning region and each adjacent load accepting region, the region spanning the load accepting regions having a midpoint therealong, the distance in the plane perpendicular to the axis between the axis and the midpoint being defined by a predetermined reference line $R_0$, the distance in the plane perpendicular to the axis between the axis and the transition point being defined by a predetermined reference line $R_T$, the distance in the plane perpendicular to the axis between the axis and the midpoint of a load accepting region being defined by a predetermined reference line $R_L$, characterized in that the region of the band spanning the applied load accepting regions has an equilibrium curve and that each load accepting region has an equilibrium curve, such that, in the plane perpendicular to the axis, at any angular position Θ from the transition point to the reference line $R_L$, each point on the equilibrium curve of the applied load accepting region lies a predetermined distance $R_{actual}$ from the axis, each distance $R_{actual}$ approximating a reference distance R, where the reference distance R at the corresponding angular position Θ is defined by the relationship:

$$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)\partial$$

$$K_2=[(R_L\sigma_c H)/T_0] \quad (2B)$$

where $Z=R_0/R_L$

ω is the angular speed,

γ is the density of the band, g is the acceleration due to gravity, t is the thickness of the band, σ is the applied load per unit area in the load accepting region of the band H is the height of the band, and $T_0$ is the tensile force in the band at the midpoint thereof the cross sectional area of the band being constant at each point therealong intermediate the applied load accepting regions such that, when the band is rotated, it is loaded only by a tensile stress.

16. The band of claim 15 characterized in that, in the plane perpendicular to the axis, at any angular position Θ from the transition point to the reference line $R_L$, each point on the equilibrium curve of the region of the band spanning the applied load accepting regions lies a predetermined distance R from the axis, the distance R at the corresponding angular position Θ being defined by the relationship:

$$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1}. \quad (1BB)$$

17. A centrifuge rotor comprising:

a hub having at least a first and a second strut;

a continuous band adaptable for use as an applied load accepting band mounted to the struts, the band having a central rotational axis extending therethrough, the band having a predetermined thickness t, the band having at least a first and a second applied load accepting region defined thereon and a region spanning the distance between the first and the second load accepting regions, a transition point being defined in the band between the end of the spanning region and each adjacent load accepting region, the region spanning the load accepting regions having a midpoint therealong, the distance in the plane perpendicular to the axis between the axis and the midpoint being defined by a predetermined reference line $R_0$, the distance in the plane perpendicular to the axis between the axis and the transition point being defined by a predetermined reference line $R_T$, the distance in the plane perpendicular to the axis between the axis and the midpoint of a load accepting region being defined by a predetermined reference line $R_L$, where $Z=R_0/R_L$ $\omega$ is the angular speed, $\gamma$ is the density of the band, g is the acceleration due to gravity, t is the thickness of the band, $\sigma_c$ is the applied load per unit area in the load accepting region of the band H is the height of the band, and $T_0$ is the tensile force in the band at the midpoint thereof the cross sectional area of the band being constant at each point therealong intermediate the applied load accepting regions such that, when the band is rotated, it is loaded only by a tensile stress.

18. The band of claim 17 characterized in that, in the plane perpendicular to the axis, at any angular position $\Theta$ from the transition point to the reference line $R_L$, each point on the equilibrium curve of the region of the band spanning the applied load accepting regions lies a predetermined distance R from the axis, the distance R at the corresponding angular position $\Theta$ being defined by the relationship:

$$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1}. \quad (1BB)$$

when it is removed from the struts by which it is attached to the hub and while the band is at rest, the band is characterized in that the region of the band spanning the applied load accepting regions has an equilibrium curve and that each load accepting region has an equilibrium curve band, such that, in the plane perpendicular to the axis, at any angular position $\Theta$ from the transition point to the reference line $R_L$, each point on the equilibrium curve of the applied load accepting region lies a predetermined distance R from the axis, the distance R at the corresponding angular position $\Theta$ being defined by the relationship:

19. A centrifuge rotor comprising:

a hub having at least a first and a second strut; and a continuous band adaptable for use as an applied load accepting band mounted to the struts, the band having a central rotational axis extending therethrough, the band having a predetermined thickness t, the band having at least a first and a second applied load accepting region defined thereon and a region spanning the distance between the first and the second load accepting regions, a transition point being defined in the band between the end of the spanning region and each adjacent load accepting region, $$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)\partial$$

$$K_2=[(R_L\sigma_cH)/T_0] \quad (2B)$$

the region spanning the load accepting regions having a midpoint therealong, the distance in the plane perpendicular to the axis between the axis and the midpoint being defined by a predetermined reference line $R_0$, the distance in the plane perpendicular to the axis between the axis transition point being defined by a predetermined reference line $R_T$, the distance in the plane perpendicular to the axis between the axis and the midpoint of a load accepting region being defined by a predetermined reference line $R_L$, when it is removed from the struts by which it is attached to the hub and while the band is at rest, the band is characterized in that the region of the band accepting regions has an equilibrium curve and that each load accepting region has an equilibrium curve, such that, in the plane perpendicular to the axis, at any angular position Θ from the transition point to the reference line $R_L$, each point on the equilibrium curve of the applied load accepting region lies a predetermined distance $R_{actual}$ from the axis, each distance $R_{actual}$ approximating a reference distance R, where the reference distance R at the corresponding angular position Θ is defined by the relationship:

20. The band of claim 19 characterized in that, in the plane perpendicular to the axis, at any angular position Θ from the transition point to the reference line $R_L$, each point on the equilibrium curve of the region of the band spanning the applied load accepting regions lies a predetermined distance R from the axis, the distance R at the corresponding angular position Θ being defined by the relationship:

$$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \tag{1B}$$

.where $$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1.} \tag{1BB}$$

$$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)\partial$$

$$K_2=[(R_L\sigma_c H)/T_0] \tag{2B}$$

where $Z=R_0/R_L$

ω is the angular speed,

γ is the density of the band, g is the acceleration due to gravity, t is the thickness of the band, $\sigma_c$ is the applied load per unit area in the load accepting region of the band, H is the height of the band, and $T_0$ is the tensile force in the band at the midpoint thereof the cross sectional area of the band being constant at each point therealong intermediate the applied load accepting regions such that, when the band is rotated, it is loaded only by a tensile stress.

21. A continuous band adaptable for use as an applied load accepting band in a centrifuge rotor, the rotor having at least a first and a second mounting strut thereon, the band having a central rotational axis extending therethrough, the band having a predetermined thickness t, the band having at least a first and a second applied load accepting region defined thereon and a region spanning the distance between the first and the second load accepting regions, a transition point being defined in the band between the end of the spanning region and each adjacent load accepting region, the region spanning the load accepting regions having a midpoint therealong, the distance in the plane perpendicular to the axis between the axis and the midpoint being defined by a predetermined reference line $R_0$, the distance in the plane perpendicular to the axis between the axis and the transition point being defined by a predetermined reference line $R_T$, the distance in the plane perpendicular to the axis between the axis and the midpoint of a load accepting region being defined by a predetermined reference line $R_L$, the band, when removed from struts, extends for a predetermined distance $L_{actual}$ measured along the band the region of the band spanning the applied load accepting regions between the transition points, the band, when mounted to the struts, extends for a predetermined distance $L_{assembled}$ measured along the band the region of the band spanning the applied load accepting regions between the transition points, characterized in that the region of the band spanning the applied load accepting regions has an equilibrium curve $$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1.} \quad (1BB)$$

and that each load accepting region has an equilibrium curve, such that, in the plane perpendicular to the axis, at any angular position Θ from the transition point to the reference line $R_L$, each point on the equilibrium curve of the applied load accepting region lies a predetermined distance R from the axis, the distance R at the corresponding angular position Θ being defined by the relationship:

$$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)\partial$$

$$K_2=[(R_L\sigma_cH)/T_0] \quad (2B)$$

where $Z=R_0/R_L$

ω is the angular speed,

γ is the density of the band, g is the acceleration due to gravity, t is the thickness of the band, $\sigma_c$ is the applied load per unit area in the load accepting region of the band H is the height of the band, and $T_0$ is the tensile force in the band at the midpoint thereof, the cross sectional area of the band being constant at each point therealong intermediate the applied load accepting regions such that, when the band is rotated, it is loaded only by a tensile stress, the distance $L_{assembled}$ being substantially equal to a predetermined distance $L_{equilibrium}$ defined along the equilibrium between the radial centerlines of the load accepting regions of the band.

22. The band of claim 21 characterized in that, in the plane perpendicular to the axis, at any angular position Θ from the transition point reference line $R_L$, each point on the equilibrium curve of the region of the band spanning the applied load accepting regions lies a predetermined distance R from the axis, the distance R at the corresponding angular position Θ being defined by the relationship:

23. A centrifuge rotor comprising:

a hub having at least a first and a second strut; and a continuous band adaptable for use as an applied load accepting band in a centrifuge rotor mounted to the struts, the band having a central rotational axis extending therethrough, the band having a predetermined thickness t, the band having at least a first and a second applied load accepting region defined thereon and a region spanning the distance between the first and the second load accepting regions, a transition point being defined in the band between the end of the spanning region and each adjacent load accepting region, the region spanning the load accepting regions having a midpoint therealong, the distance in the plane perpendicular to the axis between the axis and the midpoint being defined by a predetermined reference line $R_0$, the distance in the plane perpendicular to the axis between the axis and the transition point being defined by a predetermined reference line $R_T$, the distance in the plane perpendicular to the axis between the axis and the midpoint of a load accepting region being defined by a predetermined reference line $R_L$, the band, when removed from struts, extends for a predetermined distance $L_{actual}$ measured along the band the region of the band spanning the applied load accepting regions between the transition points, the band, when mounted to the struts, extends for a predetermined distance $L_{assembled}$ measured along the band the region of the band spanning the applied load accepting regions between the transition points, characterized in that the region of the band spanning the applied load accepting regions has an equilibrium curve and that each load accepting region has an equilibrium curve, such that, in the plane perpendicular to the axis, at any angular position Θ from the transition point to the reference line $R_L$, each point on the equilibrium curve of the applied load accepting region lies a predetermined distance R from the axis, the distance R at the corresponding angular position Θ being defined by the relationship:

$$\frac{d\left(\frac{R}{R_L}\right)}{d\theta}=\left(\frac{R}{R_L}\right)\sqrt{\left[\frac{R\left\{LR-\left(\frac{K_1}{2}\right)\left[\left(\frac{R}{R_L}\right)^2-1\right]+K_2\left[\left(\frac{R}{R_L}\right)-1\right]\right\}}{LR\left\{R_L+\frac{t^2}{6(2R_L-t)}-\frac{t^2\left[LR-\left(\frac{K_1}{2}\right)\left[\left(\frac{R}{R_L}\right)^2-1\right]-K_2\left[\left(\frac{R}{R_L}\right)-1\right]\right]}{6(2R-t)}\right\}}\right]^2-1} \quad (1B)$$

where $$LR=Load\ Ratio=\{ZR_L+[t^2/((6(2ZR_L-t))]\}/\{R_L+[t^2/((6(2R_L-t))]\}$$

$$K_1=[(\gamma\omega^2R_L^2)\ (1/g)\ (1/\sigma_0)\partial$$

$$K_2=[(R_L\sigma_cH)/T_0] \quad (2B)$$

where $Z=R_0/R_L$

ω is the angular speed,

γ is the density of the band, g is the acceleration due to gravity, t is the thickness of the band, $\sigma_c$ is the applied load per unit area in the load accepting region of the band H is the height of the band, and $T_0$ is the tensile force in the band at the midpoint thereof the cross sectional area of the band being constant at each point therealong intermediate the applied load accepting regions such that, when the band is rotated, it is loaded only by a tensile stress, the distance $L_{assembled}$ being substantially equal to a predetermined distance $L_{equilibrium}$ defined along the equilibrium between the radial centerlines of the load accepting regions of the band.

24. The band of claim 23 characterized in that, in the plane perpendicular to the axis, at any angular position Θ from the transition point to the reference line $R_L$, each point on the equilibrium curve of the region of the band spanning the applied load accepting regions lies a predetermined distance R from the axis, the distance R at the corresponding angular position Θ being defined by the relationship:

$$\frac{d\left(\frac{R}{R_0}\right)}{d\theta}=\left(\frac{R}{R_0}\right)\sqrt{\left[\frac{R\left[1-K_1\left[\left(\frac{R}{R_0}\right)^2-1\right]\right]}{ZR_L+\left(\frac{t^2}{6(2ZR_L-t)}\right)-\left(\frac{t^2\left[1-K_1\left[\left(\frac{R}{R_0}\right)^2-1\right]\right]}{6(2R-t)}\right)}\right]^2-1.} \quad (1BB)$$

* * * * *